US008791058B2

(12) United States Patent
Karagianni et al.

(10) Patent No.: US 8,791,058 B2
(45) Date of Patent: Jul. 29, 2014

(54) COMPOSITION FOR HOUSEHOLD CARE CONTAINING A CATIONIC NANOGEL

(75) Inventors: Katerina Karagianni, Paris (FR); Iñigo Gonzalez, Paris (FR); David James Wilson, Coy-la-Forêt (FR)

(73) Assignee: Rhodia Operations, Aubervilliers (FR)

( * ) Notice: Subject to any disclaimer, the term of this patent is extended or adjusted under 35 U.S.C. 154(b) by 299 days.

(21) Appl. No.: 13/125,769

(22) PCT Filed: Oct. 19, 2009

(86) PCT No.: PCT/EP2009/063670

§ 371 (c)(1),
(2), (4) Date: Jun. 27, 2011

(87) PCT Pub. No.: WO2010/046342

PCT Pub. Date: Apr. 29, 2010

(65) Prior Publication Data

US 2011/0271460 A1 Nov. 10, 2011

(30) Foreign Application Priority Data

Oct. 22, 2008 (FR) ..... 08 05854

(51) Int. Cl.
*C11D 3/37* (2006.01)

(52) U.S. Cl.
USPC ..... 510/475; 510/180; 510/191; 510/221; 510/235; 524/548; 524/556; 525/326.7; 525/329.4; 525/330.3

(58) Field of Classification Search
USPC ..... 510/475, 180, 191, 221, 235; 524/548, 524/556; 525/326.7, 329.4, 330.3
See application file for complete search history.

(56) References Cited

U.S. PATENT DOCUMENTS

| | | | | |
|---|---|---|---|---|
| 4,728,455 | A | 3/1988 | Rerek | |
| 5,108,660 | A | 4/1992 | Michael | |
| 5,114,606 | A | 5/1992 | Van Vliet et al. | |
| 5,280,117 | A | 1/1994 | Kerschner et al. | |
| 5,536,452 | A | 7/1996 | Black | |
| 5,559,261 | A | 9/1996 | Sivik | |
| 5,587,022 | A | 12/1996 | Black | |
| 2005/0245668 | A1 | 11/2005 | Green et al. | |
| 2006/0074003 | A1 | 4/2006 | Martin et al. | |
| 2010/0004152 | A1 * | 1/2010 | Karagianni et al. | 510/180 |
| 2010/0028708 | A1 * | 2/2010 | Pawlik et al. | 428/596 |

FOREIGN PATENT DOCUMENTS

| | | | |
|---|---|---|---|
| EP | 0909809 | A2 | 4/1999 |
| EP | 1698688 | A1 | 9/2006 |
| JP | 50127991 | | 8/1975 |
| WO | WO 9623860 | | 8/1996 |
| WO | WO 9623861 | | 8/1996 |
| WO | WO 9626859 | | 8/1996 |
| WO | WO 9630421 | | 10/1996 |
| WO | WO 9801478 | | 1/1998 |
| WO | 98/31739 | * | 7/1998 |
| WO | WO 9831739 | | 7/1998 |
| WO | WO 9858974 | | 12/1998 |
| WO | WO 9903894 | | 1/1999 |
| WO | WO 9931144 | | 6/1999 |
| WO | WO 0037507 | | 6/2000 |
| WO | WO 0039169 | | 7/2000 |
| WO | WO 0056792 | | 9/2000 |
| WO | WO 0075207 | A1 | 12/2000 |
| WO | WO 0210223 | A2 | 2/2002 |
| WO | WO 0226836 | A2 | 4/2002 |
| WO | WO 03018650 | A1 | 3/2003 |
| WO | WO 2004048428 | | 6/2004 |
| WO | WO 2004048429 | | 6/2004 |
| WO | WO 2007071591 | A1 | 6/2007 |
| WO | WO 2009037188 | A1 | 3/2009 |

OTHER PUBLICATIONS

Braun; Initiation of Free Radical Polymerization by Thermal Cleavage of Carbon-Carbon Bonds; Macromol. Symps. vol. 111, pp. 63-71 (1996).

Matyjaszewski et al; controlled Radical Polymerizations: The Use of Alkyl Iodides in Degenerative Transfer; Macrololecules; vol. 28, pp. 2093-2095 (1995).

Otsu et al; Role of Initiator-Transfer Agent-Terminator (iniferter) in Radical Polymerizations: Polymer Deign by Organic Disulfides as Iniferters; Makromol. Chem., Rapid Commun.; vol. 3; pp. 127-132 (1983).

Wayland et al; Living Radical Polmerization of Acrylates by Organocobalt Porphyrin Complexes; J. Am. Chem. Soc.; vol. 116; pp. 7943-7944 (1994).

* cited by examiner

*Primary Examiner* — Charles Boyer
(74) *Attorney, Agent, or Firm* — Hunton & Williams LLP

(57) ABSTRACT

The present invention relates to compositions for household care which include a cationic nanogel, particularly for treating and/or modifying hard or textile surfaces. The composition particularly enables a hydrophilization of hard surfaces, particularly useful in cleaning or rinsing operations.

19 Claims, No Drawings

COMPOSITION FOR HOUSEHOLD CARE CONTAINING A CATIONIC NANOGEL

CROSS-REFERENCE TO RELATED APPLICATIONS

This application is the U.S. National Phase of International Application No. PCT/FR2009/063670 filed on Oct. 19, 2009, which claims priority to French Application No. FR 08/05854 filed Oct. 22, 2008, both of which are incorporated by reference herein in their entireties.

FIELD OF THE INVENTION

The present invention relates to compositions for household care comprising a cationic nanogel, especially for treating and/or modifying hard or textile surfaces. The composition especially allows hydrophilization of hard surfaces, which is useful especially in cleaning or rinsing operations.

BACKGROUND

Household care compositions comprise various ingredients which, individually or in combination, give said compositions the usual properties for the use for which they are intended, or modify certain properties. Cleaning compositions, for example, often comprise surfactants. Certain compositions comprise polymers, for example in order to give them particular rheological properties (for example to thicken them) or in order to modify surface properties, especially by deposition.

There is a constant need for novel ingredients, especially for polymers, and for novel combinations, in order to design household care compositions that have new properties, improved properties, or more simply to conserve the same properties with simpler and/or more economical compositions.

The patent application filed at the European Patent Office on Sep. 20, 2007 under the number 07291118.3 describes, for example, the use of certain cationic linear statistical copolymers for improving foam stability especially in laundry-care foaming compositions. However, the compositions comprising this copolymer cannot prevent the redeposition of soiling on the laundry. There is a need for polymers for improving the foam stability and for improving the prevention of redeposition.

Document WO 2007/071591 describes the use of nanogels for treating hard surfaces. Said document especially teaches, in examples 3.1 and 3.2, that star copolymers containing cationic peripheral branches can facilitate the cleaning of bathroom surfaces. However, these copolymers require sequential multistep polymerization processes, which make them expensive. Relative to star copolymers, there is a need for compounds that are simpler to prepare and/or for compounds that have applicative advantages at least of the same order of magnitude, if not higher, and/or that moreover have other advantages. There is also a need for polymers that afford a longer-lasting treatment, for example that afford ease of cleaning even after more time and/or being subjected to treatments with water, for example during rinsing, splashing or cleaning in the absence of polymer. The document also teaches, in example 6.1, that nanogels composed of a neutral core C without peripheral branches afford good hydrophilization. There too there is also a need for polymers that afford a longer-lasting treatment, for example that afford ease of cleaning even after more time and/or being subjected to treatments with water, for example during rinsing, splashing or cleaning in the absence of polymer.

Moreover, nanogels or microgels and processes for preparing them have been described in the literature.

Document. WO 2004/048 429 describes a process for preparing microgels based on monofunctional and multifunctional monomers in which the reactivity of these two types of monomer is appropriately chosen so as to produce discrete particles with an average molecular mass of at least $10^5$. In the examples, noncationic nanogels based especially on methyl (meth)acrylate are prepared.

Document WO 2004/048 428 describes microgels that are characterized by certain rheological properties. In the examples, noncationic nanogels based especially on methyl (meth)acrylate are prepared.

Document WO 0056792 describes gels prepared from triethylenically unsaturated monomers. In the examples, noncationic nanogels based especially on acrylamide are prepared.

Document WO 98/31739 describes the preparation of nanogels by controlled radical polymerization using nitroxides. In the examples, noncationic nanogels based especially on styrene monomers are prepared.

There is a need for other polymers, that may find use in compositions for household care.

SUMMARY OF THE INVENTION

The present invention satisfies at least one of the needs mentioned above, by proposing a composition for household care comprising a cationic nanogel, formed from chemically crosslinked macromolecules with a core C comprising:

- crosslinking units R derived from a crosslinking monomer R comprising at least two polymerizable groups, and
- core units C derived from at least one monomer C comprising only one polymerizable group, comprising:
  - cationic or potentially cationic units $C_{cat}$ derived from at least one cationic or potentially cationic monomer $C_{cat}$, and
  - optionally hydrophilic or hydrophobic neutral units $C_N$, derived from at least one hydrophilic or hydrophobic neutral monomer $C_N$, the nanogel being different than a star copolymer comprising macromolecular branches at the periphery of the core, the average size of the macromolecules preferably being from 5 to 500 nm and preferably from 30 to 170 nm.

The invention also relates to the use of the cationic nanogel in household care compositions. The cationic nanogel may especially be used as foam stabilizer, preferably on addition of soiling, and/or as anti-redeposition agent or as hydrophilization agent and/or as antisoiling agent. The invention also relates to the use of the compositions in the context of household care, for example in the context of treatment, preferably cleaning, of hard surfaces or textile surfaces.

DEFINITIONS

The nanogels used for the invention are macromolecules. They are occasionally referred to as "polymer(s)" or "copolymer(s)" in the present patent application.

In the present patent application, the mean size of the macromolecules is defined as the mean hydrodynamic diameter measured by light scattering (dynamic light scattering).

In the present patent application, the term nanogel means a macromolecular copolymer compound with a core. A core is a chemically crosslinked macromolecule comprising units derived from a monomer comprising only one polymerizable function and units comprising at least two polymerizable functions. The nanogel of the invention is different than a nanogel comprising at the periphery of the core macromolecular branches, connected to the core. The term "core" is used as opposed to macromolecular branches at the periphery. Nanogels with a core and no peripheral branches are macromolecular architectures known to those skilled in the art. The term "star copolymer" is occasionally used to denote nanogels comprising macromolecular branches at the periphery of the core.

In the present patent application, the term "core C" means a nanogel comprising a chemically crosslinked polymeric core, but not comprising any macromolecular branches at the periphery of the core. They are microscopic macromolecules with intra-chain crosslinks. Such cores C may be obtained by copolymerization of a monomer C bearing only one polymerizable group and of a crosslinking monomer R bearing at least two polymerizable groups (crosslinking monomer), in the absence of surfactant, or in the presence of a small amount of surfactant (for example less than 10% by weight, preferably less than 5% by weight, or even less than 1% by weight or none at all). They are especially distinguished in this from "nanolatices", which are polymers obtained by emulsion polymerization in the presence of large amounts of surfactants at thermodynamic equilibrium or close thereto.

In the present patent application, the term unit derived from a monomer denotes a unit that may be obtained directly from said monomer by polymerization. Thus, for example, a unit derived from an acrylic or methacrylic acid ester does not cover a unit of formula —$CH_2$—CH(COOH)—, —$CH_2$—C($CH_3$)(COOH)— or —$CH_2$—CH(OH)—, respectively, obtained, for example, by polymerizing an acrylic or methacrylic acid ester, or vinyl acetate, respectively, followed by hydrolyzing. A unit derived from acrylic or methacrylic acid covers, for example, a unit obtained by polymerizing a monomer (for example an acrylic or methacrylic acid ester) and then by reacting (for example by hydrolysis) the polymer obtained so as to obtain units of formula —$CH_2$—CH(COOH)—, or —$CH_2$—C($CH_3$)(COOH)—. A unit derived from a vinyl alcohol covers, for example, a unit obtained by polymerizing a monomer (for example a vinyl ester) and then by reacting (for example by hydrolysis) the polymer obtained so as to obtain units of formula —$CH_2$—CH(OH)—.

The following symbols are defined:

$N_R$ is the number of polymerizable functions (typically ethylenically unsaturated functions) in a crosslinking monomer R, $n_R$ is the number of moles of crosslinking monomer(s) R, $n_T$ is the total number of moles of monomers (monomer(s) C+monomer(s) R), $N_{control}$ is the number of control groups in a control agent if such an agent is used during the polymerization, $n_{control}$ is the number of moles of control agent if such an agent is used during the polymerization, $r=(N_{control}*n_{control}/n_T)/(N_R/2)*(n_R/n_T)=2*(N_{control}*n_{control})/(N_R*n_R)$ In the present patent application, the term "hydrophobic", for a monomer, is used in its usual sense as "which has no affinity for water"; this means that the monomer can form a two-phase macroscopic solution in distilled water at 25° C., at a concentration of greater than or equal to 1% by weight, or that it has been categorized as hydrophobic in the present patent application.

In the present patent application, the term "hydrophilic", for a monomer, is also used in its usual sense as "which has affinity for water", i.e. which is incapable of forming a two-phase macroscopic solution in distilled water at 25° C. at a concentration of greater than or equal to 1% by weight, or that it has been characterized as hydrophilic in the present patent application.

The term cationic or potentially cationic units means units that comprise a cationic or potentially cationic group. The cationic units or groups are units or groups that bear at least one positive charge (generally associated with one or more anions such as the chloride ion, the bromide ion, a sulfate group or a methyl sulfate group), irrespective of the pH of the medium into which the nanogel is introduced. The potentially cationic units or groups are units or groups that may be neutral or bear at least one positive charge depending on the pH of the medium into which the nanogel is introduced. In this case, they will be referred to as potentially cationic units in neutral form or in cationic form. By extension, reference may be made to cationic or potentially cationic monomers.

DETAILED DESCRIPTION OF PREFERRED EMBODIMENTS

The term anionic or potentially anionic units means units that comprise an anionic or potentially anionic group. The anionic units or groups are units or groups that bear at least one negative charge (generally associated with one or more cations such as cations of alkali metal or alkaline-earth metal compounds, for example sodium, or with one or more cationic compounds such as ammonium), irrespective of the pH of the medium in which the nanogel is present. The potentially anionic units or groups are units or groups that may be neutral or bear at least one negative charge, depending on the pH of the medium in which the nanogel is present. In this case, they will be referred to as potentially anionic units in neutral form or in anionic form. By extension, reference may be made to anionic or potentially anionic monomers.

The term neutral units means units that do not bear a charge, irrespective of the pH of the medium in which the nanogel is present.

The term "remanent antideposition and/or antiadhesion properties" means that the treated surface conserves these properties over time, including after subsequent contact with soiling (for example rainwater, water from the rinsing-water distribution network optionally containing rinsing products, splashes, fats, soaps, etc.). This remanence property may be observed beyond three rinsing cycles, or even, in certain particular cases where the rinses are numerous (for example in the case of toilets), beyond 6, 10 or 100 rinsing cycles.

The above expression "giving the surface antideposition properties" more particularly means that the treated surface, placed in contact with soiling in a predominantly aqueous medium, will not have a tendency to "take up" said soiling, which thus significantly reduces the deposition of soiling on the surface.

The above expression "giving the surface antiadhesion properties" more particularly means that the treated surface is only sparingly liable to interact with the soiling that is deposited thereon, which allows easy removal of the soiling from the soiled treated surface; specifically, during the drying of the soiling placed in contact with the treated surface, the bonds developed between the soiling and the surface are very weak; thus, breaking these bonds requires less energy (and thus less effort) during the cleaning operation.

When it is stated that the presence of the nanogel makes it possible "to improve the cleaning capacity" of a formulation, this means that, for the same amount of cleaning formulation (especially a washing-up formulation), the formulation containing the nanogel allows a larger number of soiled objects to be cleaned than a formulation that is free of nanogel.

In addition, the deposition on a hard surface of the nanogel affords this surface antistatic properties; this property is particularly advantageous in the case of synthetic surfaces.

The presence of the nanogel in formulations for treating a hard surface makes it possible to make the surface hydrophilic or to improve its hydrophilicity.

The hydrophilization property of the surface furthermore makes it possible to reduce the formation of fogging on the surface; this benefit may be exploited in cleaning formulations for glasses and mirrors, in particular in bathrooms. Furthermore, the rate of drying of the surface, immediately after its treatment by applying the polymer but also after subsequent and repeated contact with an aqueous medium, is very significantly improved.

The term "hard surfaces" should be taken in the broad sense; these are nontextile surfaces, which may be household, public or industrial surfaces.

They may be made of any material, especially such as:

- ceramic (surfaces such as sinks, baths, wall or floor tiles, toilet pans, etc.),
- glass (surfaces such as interior and exterior glazing of buildings or vehicles, mirrors,
- metal (surfaces such as inner or outer walls of reactors, blades, panels, tubes, etc.),
- synthetic resins (for example bodyworks or interior surfaces of motorized vehicles (cars, trucks, buses, trains, aircraft, etc.), surfaces made of melamine or Formica for the interior of offices, kitchens, etc.)),
- plastics (for example polyvinyl chloride, polyamide, for the interior of vehicles, especially cars).

The "hard surfaces" according to the invention are sparingly porous and nonfibrillar surfaces; they should thus be distinguished from textile surfaces (fabrics, carpets, clothing, etc. made of natural, artificial or synthetic materials).

Nanogel

The nanogel of the invention (core C) comprises:

crosslinking units R derived from a crosslinking monomer R comprising at least two polymerizable groups, and core units C derived from at least one monomer C comprising only one polymerizable group, comprising

- cationic or potentially cationic units $C_{cat}$ derived from at least one cationic or potentially cationic monomer $C_{cat}$, and
- optionally hydrophilic or hydrophobic neutral units $C_N$ derived from at least one hydrophilic or hydrophobic neutral monomer $C_N$.

The polymerizable groups of the monomers C and R are preferably ethylenically unsaturated and preferably α-ethylenically unsaturated groups. The monomers C are thus preferably monoethylenically unsaturated monomers, preferably mono-α-ethylenically unsaturated monomers. The monomers R are thus preferably polyethylenically unsaturated monomers, preferably di- or triethylenically unsaturated, for example di-α-ethylenically unsaturated or tri-α-ethylenically unsaturated monomers.

It is not excluded for the units C and the monomers C to comprise several different units or to be derived from several different monomers. It is not excluded for the units $C_{cat}$ and the monomers $C_{cat}$ to comprise several different units or to be derived from several different monomers. It is noted that the units C or the monomers C may comprise both units $C_{cat}$ and units $C_N$ or may be derived both from monomers $C_{cat}$ and $C_N$. The units C and the monomers C may also optionally comprise other types of units, or may optionally be derived from other monomers. The units C may especially also comprise zwitterionic units $C_Z$, derived from zwitterionic monomers $C_Z$, and/or anionic or potentially anionic units $C_A$ derived from anionic or potentially anionic monomers $C_A$.

The nanogel may be obtained via a process using a controlled radical polymerization process, as outlined hereinbelow.

The nanogel is different than a star copolymer comprising a core C and macromolecular branches at the periphery of the core. The nanogel may have a control group or a residue of such a group at ends of the polymer molecules.

The nanogel may especially be in the form of powder, in the form of a dispersion in a liquid or in the form of a solution in a solvent. The last two forms may be likened to forms in dispersed media. The nanogel may be included, for example, in an aqueous medium (comprising water), for example in aqueous medium or the like. The form generally depends on the requirements associated with the use of the nanogel. It may also be associated with the process for preparing the nanogel.

The nanogel may especially be formed from crosslinked macromolecules with a mean size ranging from 5 to 500 nm and preferably from 30 to 170 nm. The sizes may be conventionally determined by light scattering techniques or X-ray diffraction techniques, in dispersed media.

The nanogel, and the process for preparing it, is preferably such that it does not form a crosslinked macroscopic macromolecular network (interchain crosslinking). If it is in dispersed medium, for example in aqueous medium, the nanogel advantageously has a viscosity (Brookfield) of less than 20 000 cP and preferably less than 10 000 cP, at 25° C., at a shear rate of 100 $s^{-1}$ or less, or preferably at a shear rate of 10 $s^{-1}$.

It has especially been noted that nanogels bearing cationic or potentially cationic units $C_{cat}$ may have particularly small sizes, and that processes using monomers $C_{cat}$ may make it possible to substantially reduce the size of the nanogels. The invention may make it possible to reduce the sizes in a simple manner.

The nanogel (core C) comprises polymerized units. All the units mentioned below may be envisioned, as may combinations thereof. Certain combinations are the subject of particular embodiments.

As examples of potentially cationic monomers $C_{cat}$ from which the potentially cationic units $C_{cat}$ may be derived, mention may be made of:

- α,β-monoethylenically unsaturated carboxylic acid N,N-(dialkylamino-ω-alkyl)amides, such as N,N-dimethylaminomethyl-acrylamide or -methacrylamide, 2-(N,N-dimethylamino)ethyl-acrylamide or -methacrylamide, 3-(N,N-dimethylamino)propyl-acrylamide or -methacrylamide, 4-(N,N-dimethylamino)butyl-acrylamide or -methacrylamide,
- α,β-monoethylenically unsaturated amino esters, for instance 2-(dimethylamino)ethyl acrylate (ADAM), 2-(dimethylamino)ethyl methacrylate (DMAM or MADAM), 3-(dimethylamino)propyl methacrylate, 2-(tert-butylamino)ethyl methacrylate, 2-(dipentylamino)ethyl methacrylate, 2-(diethylamino)ethyl methacrylate,
- vinylpyridines,
- vinylamine,
- vinylimidazolines,
- monomers that are precursors of amine functions such as N-vinylformamide, N-vinylacetamide, etc., which generate primary amine functions by simple acidic or basic hydrolysis,
- mixtures or combinations thereof.

As examples of cationic monomers $C_{cat}$ from which the cationic units $C_{cat}$ may be derived, mention may be made of:

ammoniumacryloyl or acryloyloxy monomers such as trimethylammoniumpropyl methacrylate salts, in particular the chloride, trimethylammoniumethylacrylamide or methacrylamide chloride or bromide, trimethylammoniumbutylacrylamide or methacrylamide methyl sulfate, trimethylammoniumpropylmethacrylamide methyl sulfate (MAPTA MeS), (3-methacrylamidopropyl)trimethylammonium chloride (MAPTAC), (3-acrylamidopropyl)trimethylammonium chloride or methyl sulfate (APTAC or APTA MeS), methacryloyloxyethyltrimethylammonium chloride or methyl sulfate, acryloyloxyethyltrimethylammonium (Adamquat) salts, such as acryloyloxyethyltrimethylammonium chloride; or acryloyloxyethyltrimethylammonium methyl sulfate (Adamquat Cl or Adamquat MeS), methyldiethylammonium ethyl acrylate methyl sulfate (Adaequat MeS), benzyldimethylammonium ethyl acrylate chloride or methyl sulfate (Adamquat BZ 80), 1-ethyl-2-vinylpyridinium or 1-ethyl-4-vinylpyridinium bromide, chloride or methyl sulfate;

N,N-dialkyldiallylamine monomers, such as N,N-di-methyldiallylammonium chloride (DADMAC);

dimethylaminopropylmethacrylamide N-(3-chloro-2-hydroxypropyl)trimethylammonium chloride (DIQUAT chloride), dimethylaminopropylmethacrylamide N-(3-methyl sulfate-2-hydroxypropyl)trimethylammonium methyl sulfate (DIQUAT methyl sulfate), the monomer of formula

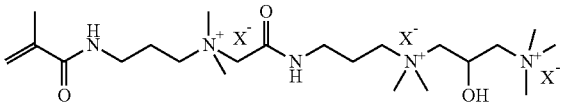

in which $X^-$ is an anion, preferably chloride or methyl sulfate, mixtures or combinations thereof.

By way of example of hydrophilic neutral monomers $C_{Nphilic}$ from which the hydrophilic neutral units $C_{Nphilic}$ may be derived, mention may be made of:

hydroxyalkyl esters of α,β-ethylenically unsaturated acids such as hydroxyethyl or hydroxypropyl acrylates and methacrylates, glycerol monomethacrylate, etc., α,β-ethylenically unsaturated amides such as acrylamide, methacrylamide, N,N-dimethylmethacrylamide, N-methylolacrylamide, etc., α,β-ethylenically unsaturated monomers bearing a water-soluble polyoxyalkylene segment of the polyethylene oxide type, such as polyethylene oxide α-methacrylates (Bisomer S20W, S10W, etc. from Laporte) or α,ω-dimethacrylates, Sipomer BEM from Rhodia (ω-behenyl polyoxyethylene methacrylate), Sipomer SEM-25 from Rhodia (ω-tristyrylphenyl polyoxyethylene methacrylate), etc., vinyl alcohol, α,β-ethylenically unsaturated monomers that are precursors of hydrophilic units or segments, such as vinyl acetate, which, once polymerized, may be hydrolyzed to generate vinyl alcohol units or polyvinyl alcohol segments, vinyllactams, such as vinylpyrrolidones, or N-vinyl-caprolactam, α,β-ethylenically unsaturated monomers of ureido type and in particular 2-imidazolidinoneethylmethacrylamide (Sipomer WAM II from Rhodia), nonethylene glycol methyl ether acrylate or nonethylene glycol methyl ether methacrylate, mixtures or combinations thereof.

As examples of hydrophobic neutral monomers $C_{Nphobic}$ from which the hydrophobic neutral units $C_{Nphobic}$ may be derived, mention may be made of:

vinylaromatic monomers such as styrene, α-methylstyrene, vinyltoluene, etc., vinyl or vinylidene halides, such as vinyl chloride or vinylidene chloride, $C_1$-$C_{12}$ alkyl esters of α,β-monoethylenically unsaturated acids such as methyl, ethyl or butyl acrylates and methacrylates, 2-ethylhexyl acrylate, etc., vinyl or allyl esters of saturated carboxylic acids such as vinyl or allyl acetates, propionates, versatates, stearates, etc., α,β-monoethylenically unsaturated nitriles containing from 3 to 12 carbon atoms, for instance acrylonitrile, methacrylonitrile, etc., α-olefins such as ethylene, etc., conjugated dienes, for instance butadiene, isoprene, chloroprene, monomers that are capable of generating polydimethylsiloxane (PDMS) chains. Thus, part B may be a silicone, for example a polydimethylsiloxane chain or a copolymer comprising dimethylsiloxy units, diethylene glycol ethyl ether acrylate or diethylene glycol ethyl ether methacrylate, mixtures or combinations thereof.

As examples of anionic or potentially anionic monomers $C_A$ from which anionic or potentially anionic units $C_A$ may be derived, mention may be made of:

monomers bearing at least one carboxylic function, such as α,β-ethylenically unsaturated carboxylic acids or the corresponding anhydrides, such as acrylic, methacrylic or maleic acids or anhydrides, fumaric acid, itaconic acid, N-methacryloylalanine, N-acryloylglycine and water-soluble salts thereof, monomers that are precursors of carboxylate functions, such as tert-butyl acrylate, which generate, after polymerization, carboxylic functions by hydrolysis, monomers bearing at least one sulfate or sulfonate function, such as 2-sulfooxyethyl methacrylate, vinylbenzenesulfonic acid, allylsulfonic acid, 2-acrylamido-2-methylpropanesulfonic, sulfoethyl acrylate or methacrylate, sulfopropyl acrylate or methacrylate, and water-soluble salts thereof, monomers bearing at least one phosphonate or phosphate function, for instance vinylphosphonic acid, etc., ethylenically unsaturated phosphate esters such as phosphates derived from hydroxyethyl methacrylate (Empicryl 6835 from Rhodia) and those derived from polyoxyalkylene methacrylates and water-soluble salts thereof, mixtures or combinations thereof.

As examples of zwitterionic monomers $C_Z$ from which the zwitterionic units $C_Z$ may be derived, mention may be made of:

monomers bearing a carboxybetaine group, monomers bearing a sulfobetaine group, for example sulfopropyldimethylammoniumethyl methacrylate (SPE), sulfoethyldimethylammoniumethyl methacrylate, sulfobutyldimethylammoniumethyl methacrylate, sulfohydroxypropyldimethylammoniumethyl methacrylate (SHPE), sulfo-propyldimethylammoniumpropylacrylamide, sulfopropyl-dimethylammoniumpropylmethacrylamide (SPP), sulfo-hydroxypropyldimethylammoniumpropylmethacrylamide (SHPP), sulfopropyldiethylammoniumethyl methacrylate or sulfohydroxypropyldiethylammoniumethyl methacrylate, monomers bearing a phosphobetaine group, such as phostatoethyltrimethylammoniumethyl methacrylate, mixtures or combinations thereof.

The crosslinking monomers R from which the crosslinking units R may be derived may be chosen especially froth organic compounds comprising at least two ethylenic unsaturations and not more than 10 unsaturations and that are known as being reactive via a radical route. Preferably, these monomers bear two or three ethylenic unsaturations.

Thus, mention may be made especially of acrylic, methacrylic, acrylamido, methacrylamido, vinyl ester, vinyl ether, diene, styrene, α-methylstyrene and allyl derivatives. These monomers may also contain functional groups other than ethylenic unsaturations, for example hydroxyl, carboxyl, ester, amide, amino or substituted amino, mercapto, silane, epoxy or halo functions.

The monomers belonging to these families are divinylbenzene and divinylbenzene derivatives, vinyl methacrylate, methacrylic acid anhydride, allyl methacrylate, ethylene glycol dimethacrylate, phenylene dimethacrylate, diethylene glycol dimethacrylate, triethylene glycol dimethacrylate, tetraethylene glycol dimethacrylate, polyethylene glycol 200 dimethacrylate, polyethylene glycol 400 dimethacrylate, 1,3-butanediol dimethacrylate, 1,4-butanediol dimethacrylate, 1,6-hexanediol dimethacrylate, 1,12-dodecanediol dimethacrylate, 1,3-glycerol dimethacrylate, diurethane dimethacrylate and trimethylolpropane trimethacrylate. For the multifunctional acrylate family, mention may be made especially of vinyl acrylate, bisphenol A epoxy diacrylate, dipropylene glycol diacrylate, tripropylene glycol diacrylate, polyethylene glycol 600 diacrylate, ethylene glycol diacrylate, diethylene glycol diacrylate, triethylene glycol diacrylate, tetraethylene glycol diacrylate, ethoxylated neopentyl glycol diacrylate, butanediol diacrylate, hexanediol diacrylate, aliphatic urethane diacrylate, trimethylolpropane triacrylate, ethoxylated trimethylolpropane triacrylate, propoxylated trimethylolpropane triacrylate, propoxylated glycerol triacrylate, aliphatic urethane triacrylate, trimethylolpropane tetraacrylate, dipentaerythritol pentaacrylate. As regards the vinyl ethers, mention may be made especially of vinyl crotonate, diethylene glycol divinyl ether, 1,4-butanediol divinyl ether, triethylene glycol divinyl ether. For the allylic derivatives, mention may be made especially of diallyl phthalate, diallyldimethylammonium chloride, diallyl maleate, sodium diallyloxyacetate, diallylphenylphospine, diallyl pyrocarbonate, diallyl succinate, N,N'-diallyltartardiamide, N,N-diallyl-2,2,2-trifluoroacetamide, the allylic ester of diallyloxyacetic acid, 1,3-diallylurea, triallylamine, triallyl trimesate, triallyl cyanurate, triallyl trimellitate, triallyl-1,3,5-triazine-2,4,6-(1H,3H,5H)-trione. For the acrylamido derivatives, mention may be made especially of N,N'-methylenebisacrylamide, N,N'-methylenebismethacrylamide, glyoxal bisacrylamide, diacrylamido acetic acid. As regards the styrene derivatives, mention may be made especially of divinylbenzene and 1,3-diisopropenylbenzene. In the case of diene monomers, mention may be made especially of butadiene, chloroprene and isoprene.

As polyethylenically unsaturated monomers, N,N'-methylenebisacrylamide (MBA), divinylbenzene (DVB), ethylene glycol diacrylate, triallyl cyanurate (TAC) or trimethylolpropane triacrylate are preferred.

These polyethylenically unsaturated monomers may be used alone or as mixtures.

If the nanogel comprises units $C_N$, they may advantageously be units $C_{Nphilic}$ derived from a hydrophilic neutral monomer $C_{Nphilic}$. The mole ratio between the units $C_{cat}$ and the units $C_N$, preferably $C_{Nphilic}$, may especially be between 1/99 and 99/1, preferably between 1/99 and 50/50, preferably between 1/99 and 40/60, preferably between 1/99 and 25/75, for example between 2/99 and 10/90.

Nanogels whose composition of units C is as follows may especially be prepared:

APTAC/AM, for example in an APTAC/AM mole ratio from 1/99 to 40/60 and preferably from 5/95 to 30/70, DIQUAT/AM, for example in a DIQUAT/AM mole ratio from 1/99 to 10/90, MAPTAC/AM, for example in a MAPTAC/AM mole ratio from 1/99 to 10/90.

Processes that Are Useful for Preparing the Nanogel

All the processes for preparing nanogels as described above may be used.

Processes that are particularly advantageous use a controlled (or "living") polymerization, with the aid of a control agent or group (occasionally referred to as a transfer group), for example via a controlled (or "living") radical polymerization process. Such processes are known to those skilled in the art. It is mentioned that it is not excluded to use other methods, especially ring-opening polymerizations (especially anionic or cationic) or anionic or cationic polymerizations.

As examples of living or controlled radical polymerization processes, reference may be made especially to the following processes:

the processes of patent applications WO 98/58974, WO 00/75207 and WO 01/42312 which use a radical polymerization controlled with control agents of xanthate type, the radical polymerization process controlled with control agents of dithioester or trithiocarbonate type of patent application WO 98/01478, the radical polymerization process controlled with control agents of dithiocarbamate type of patent application WO 99/31144, the radical polymerization process controlled with control agents of dithiocarbazate type of patent application WO 02/26836, the radical polymerization process controlled with control agents of dithiophosphoroester type of patent application WO 02/10223, (optionally, the copolymers obtained above by controlled radical polymerization may undergo a reaction for purification of their sulfur-chain end, for example via processes such as hydrolysis, oxidation, reduction, pyrolysis or substitution), the process of patent application WO 99/03894 which uses a polymerization in the presence of nitroxide precursors, the process of patent application WO 96/30421, which uses an atom-transfer radical polymerization (ATRP), the radical polymerization process controlled with control agents of iniferter type according to the teaching of Otu et al., Makromol. Chem. Rapid. Commun., 3, 127 (1982), the radical polymerization process controlled by iodine degenerative transfer according to the teaching of Tatemoto et al., Jap. 50, 127, 991 (1975), Daikin Kogyo Cu ltd Japan and Matyjaszewski et al., Macromolecules, 28, 2093 (1995), the radical polymerization process controlled with tetraphenylethane derivatives, disclosed by D. Braun et al. in Macromol. Symp. 111, 63 (1996), or the radical polymerization process controlled with organocobalt complexes described by Wayland et al. in J. Am. Chem. Soc. 116, 7973 (1994), the radical polymerization process controlled with diphenylethylene (WO 00/39169 or WO 00/37507).

The controlled or living radical polymerizations using control agents or groups (or transfer agents or groups) containing a group —S—CS— (xanthates, dithioesters, trithiocarbonates, dithiocarbamates, dithiocarbazates, etc.) are particularly advantageous.

One practical process for preparing the nanogel is a preparation process comprising the following step a):

polymerization step a), preferably controlled radical polymerization, of a mixture of monomers comprising:

at least one polyethylenically unsaturated crosslinking monomer R, and at least one monoethylenically unsaturated monomer C, comprising:

at least one cationic or potentially cationic monomer $C_{cat}$, and optionally a hydrophilic or hydrophobic neutral monomer $C_N$, the process preferably not comprising a subsequent polymerization step that can lead to the formation of peripheral macromolecular branches.

The mole ratio between the monomer(s) C and the monomer(s) R is preferably greater than or equal to 50/50 (=1), preferably greater than 60/40, for example from 60/40 to 99.99/0.01, for example from 60/40 to 99.9/0.1, preferably from 60/40 to 99/1, preferably from 80/20 to 99/1 and preferably between 90/10 and 95/5. The ratio between the units C and the units R may be identical.

According to one embodiment, the nanogel is obtained via a process using a controlled radical polymerization process using control groups. In this case, the mole ratio between the number of control groups (i.e. the molar amount of control agent multiplied by the number of control groups borne by an agent) and half of the number of polymerizable groups of the crosslinking monomer R (i.e. half the molar amount of monomer multiplied by the number of unsaturated groups in the monomer) is between 0.05 and 0.5, for example between 0.05 and less than 0.1 or between 0.1 and less than 0.2, or between 0.2 and less than 0.3, or between 0.3 and less than 0.4, or between 0.4 and 0.5.

The nanogel may especially have a molar mass (typically a weight-average molar mass, typically determined by MALS-coupled gas chromatography GC or by MALS-coupled steric exclusion chromatography) of greater than or equal to 100 000 g/mol, preferably greater than or equal to 350 000 g/mol, for example between 500 000 and 3 500 000 g/mol, for example between 1 000 000 and 2 000 000 g/mol.

The polymerization of step a) may especially be performed by placing the following in contact:

the monomers, a control agent, for example an agent comprising a group —S—CS—, and a source of free radicals.

Such types of polymerization are known to those skilled in the art and have been the subject of many publications. Reference is made especially to the list established above.

It is mentioned that step a) may be followed by an optional step b) of chemical modification of the macromolecular chains and/or of deactivation of transfer groups borne by macromolecular chains, of destruction or purification of by-products of the chemical modification and/or deactivation.

Steps of chemical modification of the macromolecular chains are directed toward adding to the chains of functional groups, deleting groups from the macromolecular chains or substituting groups of macromolecular chains. These groups may especially be borne by units derived from monomers or borne at the ends of macromolecular chains. Such processes are known to those skilled in the art. Mention is made, for example, of total or partial hydrolysis steps, or total or partial crosslinking steps.

It is possible to perform the deactivation of transfer groups borne by the macromolecular chains, and/or purification and/or destruction of chemical modification and/or deactivation by-products. This may be a reaction for the purification or destruction of certain species, for example via processes such as hydrolysis, oxidation, reduction, pyrolysis, ozonolysis or substitution. An oxidation step with aqueous hydrogen peroxide solution is particularly suitable for treating sulfur species. It is mentioned that some of these reactions or operations may take place totally or partly during a chemical modification step.

The polymerization step a) will generally be performed in the presence of a control agent (or transfer agent) bearing a control group (or transfer group). The control group is preferably a group of formula —S—CS—. It is preferably a nonpolymeric transfer agent comprising a control group of formula —S—CS—. Control groups of formula —S—CS— and compounds comprising these groups, especially control agents, are known to those skilled in the art and are described in the literature. Reference is especially made to the list established above. They may especially be selected according to their reactivity toward certain monomers, and/or according to their solubility in the reaction medium.

The control group may especially comprise a group of formula —S—CS—Z— in which Z is an oxygen atom, a carbon atom, a sulfur atom, a phosphorus atom or a silicon atom, these atoms being, where appropriate, substituted so as to have a suitable valency.

An agent of xanthate type, containing a control group of formula —S—CS—O—, may especially be used.

As control agents that are particularly useful, mention is made of:

—O-ethyl-S-(1-methoxycarbonylethyl) xanthate of formula $$(CH_3CH(CO_2CH_3))S(C{=}S)OEt$$

dibenzyl trithiocarbonate of formula $\phi$-$CH_2$—S—CS—S—$CH_2$-$\phi$ phenylbenzyl dithiocarbonate of formula $\phi$-S—CS—$CH_2$-$\phi$ N,N-diethyl S-benzyldithiocarbamate of formula $(CH_3—CH_2)_2N$—CS—S—$CH_2$-$\phi$.

The polymerization step a) will generally be performed in the presence of a source of free radicals. However, for certain monomers, such as styrene, free radicals that can initiate the polymerization may be generated by a monoethylenically unsaturated monomer, at sufficiently high temperatures generally above 100° C. In this case, it is not necessary to add an additional source of free radicals.

The useful source of free radicals is generally a radical polymerization initiator. The radical polymerization initiator may be chosen from the initiators conventionally used in radical polymerization. Such an initiator may be, for example, one of the following initiators:

hydrogen peroxides such as: tert-butyl hydroperoxide, cumene hydroperoxide, t-butyl peroxyacetate, t-butyl peroxybenzoate, t-butyl peroxyoctoate, t-butyl peroxyneodecanoate, t-butyl peroxyisobutarate, lauroyl peroxide, t-amyl peroxypivalate, t-butyl peroxypivalate, dicumyl peroxide, benzoyl peroxide, potassium persulfate, ammonium persulfate, azo compounds such as: 2,2'-azobis(isobutyronitrile), 2,2'-azobis(2-butanenitrile), 4,4'-azobis(4-pentanoic acid), 1,1'-azobis(cyclohexanecarbonitrile), 2-(t-butylazo)-2-cyanopropane, 2,2'-azobis[2-methyl-N-(1,1)-bis(hydroxymethyl)-2-hydroxyethyl]propionamide, 2,2'-azobis(2-methyl-N-hydroxyethyl]propionamide, 2,2'-azobis(N,N'-dimethyleneisobutyramidine) dichloride, 2,2'-azobis(2-amidinopropane) dichloride, 2,2'-azobis (N,N'-dimethyleneisobutyramide), 2,2'-azobis(2-methyl-N-[1,1-bis(hydroxymethyl)-2-hydroxyethyl]propionamide), 2,2'-azobis(2-methyl-N-[1,1-bis (hydroxymethyl)ethyl]propionamide), 2,2'-azobis[2-methyl-N-(2-hydroxyethyl)propionamide], 2,2'-azobis (isobutyramide) dihydrate, redox systems comprising combinations such as:

mixtures of hydrogen peroxide, alkyl peroxide, peresters, percarbonates and the like and any iron salts or titanous salts, zinc formaldehyde sulfoxylate or sodium formaldehyde sulfoxylate, and reducing sugars, alkali metal or ammonium persulfates, perborate or perchlorate in combination with an alkali metal bisulfite, such as sodium metabisulfite, and reducing sugars, and alkali metal persulfates in combination with an arylphosphinic acid such as benzenephosphonic acid and the like, and reducing sugars.

The amount of initiator to be used is preferably determined such that the amount of radicals generated is not more than 50 mol % and preferably not more than 20 mol % relative to the amount of control or transfer agent.

It is mentioned that the polymerization may be performed by heating, in a known manner, so as to initiate and/or maintain the polymerization process. It is possible, for example, to work at temperatures from 50° C. to 100° C. The degree of polymerization and the masses may be controlled by controlling the polymerization time. The polymerization may especially be stopped by lowering the temperature.

The polymerizations may be performed in any appropriate physical form, for example by solution polymerization in an aqueous medium (comprising water), for example in water or in an aqueous-alcoholic medium (for example water-ethanol) or in a solvent, for example an alcohol (for example ethanol) or THF, or by emulsion polymerization, preferably in inverse emulsion, where appropriate by controlling the temperature and/or the pH so as to make the species liquid and/or soluble or insoluble. The polymerization is preferably formed in solution, as opposed to polymerizations in a dispersed phase (emulsion, microemulsion, polymerization with precipitation of the formed polymer). It is preferred to conserve the nanogel in solution after such a polymerization.

It is pointed out that the nanogels are preferably obtained directly after the polymerization and the optional deactivation, removal or destruction of transfer groups, without a functionalization step after the polymerization.

The respective and relative amounts of monomer(s) C, of crosslinking monomer(s) R and of control agent may be varied so as to control the size of the macromolecules generated, and/or so as to control the nonformation of a macroscopic macromolecular network. A few indications are given below:

for constant amounts of monomer(s) C and of control agent, when the amount of monomer(s) R is increased, the molar masses and the polydispersity index are increased, and macroscopic macromolecular networks may be formed.

for constant amounts of monomer(s) C and of monomer(s) R, when the amount of control agent is decreased, the molecular masses and the polydispersity index are increased, and macroscopic macromolecular networks may be formed, at constant amounts of control agent and of monomer(s) R, if units $C_N$ are present, when the $C_{cat}/C_N$ mole ratio is decreased, macroscopic macromolecular networks may be formed.

Preferably, the polymerization is performed in the presence of a control agent in an amount such that $(N_{control}*n_{control}/n_T)$ is from 0.05% to 10%, preferably from 0.1% to 10% and preferably from 0.2% to 5%.

Preferably, the polymerization is performed in the presence of crosslinking monomers R in an amount such that $(N_R/2)*(n_R/n_T)$ is from 0.01 mol % to 40 mol %, preferably from 0.1 mol % to 40 mol % and preferably from 1 mol % to 40 mol %, for example from 5 mol % to 20 mol %.

The polymerization is preferably, especially in one or both of the ranges mentioned above, performed in the presence of a control agent and of crosslinking monomer(s) R in amounts such that $r \geq 0.05$, preferably $r \geq 0.1$, preferably $r \geq 0.2$, preferably $r \geq 0.25$ and preferably $r \geq 0.3$. The higher the value of r, the more remote a potential zone for formation of undesired macroscopic macromolecular networks. It is not excluded for the number r to be greater than or equal to 0.5 or 1.

Composition

The household care composition may especially be for treating, preferably cleaning, hard surfaces or textile surfaces. The household cleaning operations include maintenance performed within the private residential sector, and within the public institutional or industrial sector, for example in offices, hotels, restaurants or schools, where appropriate by service companies. The treatments of textile surfaces include washing operations, on finished textile articles.

According to one embodiment, the composition is a laundry washing composition, in a machine or by hand, advantageously by hand or in a semiautomatic machine, the nanogel being used as:

foam stabilizer, preferably on addition of soiling, and/or an antiredeposition agent.

According to another embodiment, the composition is a composition for cleaning hard surfaces, the nanogel being used as hydrophilization agent and/or as antisoiling agent.

The invention also relates to a method for performing household care, comprising a step of placing a household surface, preferably a textile surface or a hard household surface, in contact with the composition, where appropriate after a preliminary dilution.

The composition is preferably a liquid composition, comprising a liquid application vector, for example water, an alcohol or a mixture. It usually comprises a surfactant.

The composition according to the invention may especially afford the hard surfaces to be treated hydrophilicity, antideposition and/or antiadhesion properties toward soiling. It may be, for example:

a cleaning or rinsing composition for household use; it may be multi-purpose or may be more specific, such as a cleaning or rinsing composition for bathrooms; said composition especially prevents the deposition of soap salts around baths and on sinks, and/ or prevents the growth and/or deposition of limescale crystals on these surfaces, and/or facilitates the direct or subsequent cleaning of soap scum and/or retards the subsequent appearance of soap scum, for kitchens; said composition makes it possible to improve the cleaning of work surfaces when they are soiled with saturated fat soiling that is liable to crosslink over time; the fat stains are removed with water without rubbing, for floors (lino, tiled or cement floors); said composition makes it possible to improve the removal of dust, soiling of argilo-calcareous types (soil, sand, mud, etc.); floor stains can be cleaned without effort by simple sweeping, without brushing; in addition, said composition affords non-slip properties, for toilets; said composition makes it possible to prevent the adhesion of traces of excrement on the surface; a simple cistern flush is sufficient to remove these traces; the use of a brush is unnecessary, glazing or mirrors; said composition makes it possible to prevent the deposition of mineral or organic particulate soiling on the surface, for washing kitchenware, by hand or in an automatic machine; said composition makes it possible, in the case of washing up by hand, to facilitate the removal of the residual marks of dried-on foods, and to wash a larger number of dining sets or utensils with the same volume of washing liquid; the surface of the dining sets and utensils while still wet is no longer slippery and thus does not slip out of the user's hands; a "squeaky-clean" effect, i.e. the surface "squeaks" when rubbed with a finger, has also been found. In the case of washing or rinsing in a dishwasher, said composition allows the antiredeposition of food soiling and of insoluble calcium mineral salts, and makes utensils and dining sets sparkle; the composition also eliminates the need to "prewash" the dining sets or utensils before placing them in the dishwasher.

A cleaning or rinsing composition for industrial or public-sector use; it may be multi-purpose or more specific, such as a composition for cleaning reactors, stainless-steel blades, sinks and tanks, kitchenware, exterior or interior surfaces of buildings, glazings of residential and nonresidential buildings, bottles.

The composition according to the invention may be in any form and may be used in many ways.

Thus, it may be in the form:

of a gelled or non-gelled liquid, to be deposited in its native form, especially by spraying, directly onto the surfaces to be cleaned or rinsed, or onto a sponge or another support (for example a woven or nonwoven cellulose article) before being applied to the surface to be treated, a gelled or non-gelled liquid, to be diluted in water (optionally containing another solvent) before being applied to the surface to be treated, of a yelled or non-yelled liquid, enclosed in a water-soluble sachet, of a foam, of an aerosol, of a liquid absorbed onto an absorbent support made especially of a woven or nonwoven article (wipe), of a solid, especially a tablet, optionally enclosed in a water-soluble sachet, said composition possibly representing all or part of the tablet.

For correct working of the invention, the nanogel is present in the composition forming the subject of the invention in an amount that is effective for modifying and/or treating the surface. It may be, for example, in an amount that is effective for giving said surfaces hydrophilicity and/or antideposition and/or antiadhesion properties toward soiling liable to be deposited on said surfaces.

Said composition forming the subject of the invention may contain, depending on its application, from 0.001% to 10% of its weight of the nanogel.

The pH of the composition or the working pH of the composition according to the invention may range, depending on the applications and the surfaces to be treated, from 1 to 14, or even from 0.5 to 14. The extreme pH values are standard in applications of industrial or public-sector cleaning type. In the field of household applications, the pH values will rather be from 1 to 13, depending on the applications.

Said composition may be used for cleaning or rinsing hard surfaces, in an amount such that, after optional rinsing and drying, the amount of polybetaine (B) deposited on the surface is from 0.0001 to 10 mg/m$^2$ and preferably from 0.001 to 5 mg/m$^2$ of treated surface.

The composition, preferably a cleaning or rinsing composition according to the invention, may also comprise at least one surfactant. This may be nonionic, anionic, amphoteric, zwitterionic or cationic. It may also be a mixture or combination of one or more surfactants.

Among the anionic surfactants, examples that may be mentioned include:

the alkyl ester sulfonates of formula R—CH($SO_3$M)-COOR', in which R represents a $C_{8-20}$ and preferably $C_{10}$-$C_{16}$ alkyl radical, R' represents a $C_1$-$C_6$ and preferably $C_1$-$C_3$ alkyl radical and M represents an alkali metal (sodium, potassium or lithium) or substituted or unsubstituted ammonium (methyl-, dimethyl-, trimethyl-, tetramethylammonium, dimethylpiperidinium, etc.) cation or an alkanolamine derivative (monoethanolamine, diethanolamine, triethanolamine, etc.). Mention may be made most particularly of methyl ester sulfonates in which the radical R is of $C_{14}$-$C_{16}$;

the alkyl sulfates of formula R$OSO_3$M, in which R represents a $C_5$-$C_{24}$ and preferably $C_{10}$-$C_{18}$ alkyl or hydroxyalkyl radical (such as the salts of fatty acids derived from coconut and from tallow), M representing a hydrogen atom or a cation of the same definition as above, and also ethoxylenated (OE) and/or propoxylenated (OP) derivatives thereof, containing on average from 0.5 to 30 and preferably from 0.5 to 10 OE and/or OP units;

the alkylamide sulfates of formula RCONHR'$OSO_3$M in which R represents a $C_2$-$C_{22}$ and preferably $C_6$-$C_{20}$ alkyl radical, R' represents a $C_2$-$C_3$ alkyl radical, M representing a hydrogen atom or a cation of the same definition as above, and also the ethoxylenated (OE) and propoxylenated (OP) derivatives thereof, containing on average from 0.5 to 60 OE and/or OP units;

salts of saturated or unsaturated $C_8$-$C_{24}$ and preferably $C_{14}$-$C_{20}$ fatty acids, $C_9$-$C_{20}$ alkylbenzenesulfonates, primary or secondary $C_8$-$C_{22}$ alkylsulfonates, alkylglycerol sulfonates, the sulfonated polycarboxylic acids described in GB-A-1 082 179, paraffin sulfonates, N-acyl N-alkyltaurates, isethionates, alkylsuccinamates, alkylsulfosuccinates, sulfosuccinate monoesters or diesters, N-acyl sarcosinates, alkylglycoside sulfates, polyethoxycarboxylates, monoglyceride sulfates, and condensates of fatty acid chloride with hydroxyalkylsulfonates; the cation may be an alkali metal (sodium, potassium or lithium), a substituted or unsubstituted ammonium residue (methyl-, dimethyl-, trimethyl-, tetramethylammonium, dimethylpiperidinium, etc.) or an alkanolamine derivative (monoethanolamine, diethanolamine, triethanolamine, etc.), alkyl phosphates, alkyl or alkylaryl phosphate esters such as Rhodafac RA600, Rhodafac PA15 or Rhodafac PA23 sold by the company Rhodia; the cation may be an alkali metal (sodium, potassium or lithium), a substituted or unsubstituted ammonium residue (methyl-, dimethyl-, trimethyl-, tetramethylammonium, dimethylpiperidinium, etc.) or an alkanolamine derivative (monoethanolamine, diethanolamine, triethanolamine, etc.).

A description of nonionic surfactants is given in U.S. Pat. No. 4,287,080 and U.S. Pat. No. 4,470,923. Mention may be made in particular of condensates of alkylene oxide, especially of ethylene oxide and optionally of propylene oxide, with alcohols, polyols, alkylphenols, fatty acid esters, fatty acid amides and fatty amines; amine oxides, sugar derivatives such as alkyl-polyglycosides or fatty acid esters and sugar esters, especially sucrose monopalmitate; long-chain (from 8 to 28 carbon atoms) tertiary phosphine oxides; dialkyl sulfoxides; block copolymers of polyoxyethylene and polyoxypropylene; polyalkoxylated sorbitan esters; fatty esters of sorbitan, poly(ethylene oxide) and fatty acid amides modified so as to give them a hydrophobic nature (for example fatty acid mono- and diethanolamides containing from 10 to 18 carbon atoms).

Mention may be made most particularly of:

polyoxyalkylenated $C_8$-$C_{18}$ aliphatic carboxylic acids containing from 2 to 50 oxyalkylene (oxyethylene and/or oxypropylene) units, in particular of $C_{12}$ (medium) or $C_{18}$ (medium), polyoxyalkylenated $C_6$-$C_{24}$ aliphatic alcohols containing from 2 to 50 oxyalkylene (oxyethylene and/or oxypropylene) units, in particular of $C_{12}$ (medium) or $C_{18}$ (medium); mention may be made of Antarox B12DF, Antarox FM33, Antarox FM63 and Antarox V74 from Rhodia, Plurafac LF 400 and Plurafac LF 220 from BASF, Rhodasurf ID 060, Rhodasurf ID 070 and Rhodasurf LA 42 from Rhodia, and Synperonic A5, A7 and A9 from ICI, amine oxides such as dodecylbis(2-hydroxyethyl)amine oxide, phosphine oxides, such as tetradecyldimethylphosphine oxide.

Among the amphoteric surfactants, mention may be made of:

sodium alkyliminopropionates or iminodipropionates, such as Mirataine H2C HA and Mirataine JC HA from Rhodia, alkylamphoacetates or alkylamphodiacetates in which the alkyl group contains from 6 to 20 carbon atoms, such as Miranol C2M Conc NP sold by Rhodia, amphoteric alkylpolyamine derivatives such as Amphionic XL® sold by Rhodia, and Ampholac 7T/X® and Ampholac 7C/X® sold by Berol Nobel.

Among the zwitterionic surfactants, mention may be made of those described in U.S. Pat. No. 5,108,660.

The preferred zwitterionic surfactants are alkyldimethylbetaines, alkylamidopropyldimethylbetaines, alkyldimethylsulfobetaines or alkylamidopropyldimethylsulfobetaines such as Mirataine JCHA or H2CHA, Mirataine CBS sold by Rhodia or those of the same type sold by Sherex Company under the names Varion CADG Betaine and Varion CAS Sulfobetaine, products of condensation of fatty acids and protein hydrolysates. Other zwitterionic surfactants are also described in U.S. Pat. No. 4,287,080 and in U.S. Pat. No. 4,557,853.

Among the cationic surfactants, mention may be made especially of the salts of quaternary ammoniums of formula:

$$R^1R^2R^3R^4N^+X^-$$

in which $R^1$, $R^2$ and $R^3$, which may be identical or different, represent H or an alkyl group containing less than 4 carbon atoms, preferably 1 or 2 carbon atoms, optionally substituted with one or more hydroxyl function(s), or may form, together with the nitrogen atom $N^+$, at least one aromatic or heterocyclic ring, $R^4$ represents a $C_3$-$C_{22}$ and preferably $C_{12}$-$C_{22}$ alkyl or alkenyl group, or an aryl or benzyl group, and $X^-$ is a solubilizing anion such as halide (for example chloride, bromide or iodide), sulfate or alkyl sulfate (methyl sulfate), carboxylate (acetate, propionate or benzoate), or alkyl or arylsulfonate.

Mention may be made in particular of dodecyltrimethylammonium bromide, tetradecyltrimethylammonium bromide, cetyltrimethylammonium bromide, stearylpyridinium chloride, Rhodaquat® TFR and Rhodamine® C15 sold by Rhodia, cetyltrimethylammonium chloride (Dehyquart ACA and/or AOR from Cognis) and cocobis(2-hydroxyethyl)ethylammonium chloride (Ethoquad C12 from Akzo Nobel).

Mention may also be made of other cationic surfactants such as:

the quaternary ammonium salts of formula:

$$R^{1'}R^{2'}R^{3'}R^{4'}N^+X^-$$

in which:

$R^{1'}$ and $R^{2'}$, which may be identical or different, represent H or an alkyl group containing less than 4 carbon atoms, preferably 1 or 2 carbon atoms, optionally substituted with one or more hydroxyl function(s), or may form, together with the nitrogen atom $N^+$, a heterocyclic ring, $R^{3'}$ and $R^{4'}$ represent a $C_8$-$C_{22}$ and preferably $C_{10}$-$C_{22}$ alkyl or alkenyl group, or an aryl or benzyl group, and $X^-$ is an anion such as halide (for example chloride, bromide or iodide), sulfate or alkyl sulfate (methyl sulfate), carboxylate (acetate, propionate or benzoate), or alkyl or arylsulfonate.

Mention may be made in particular of: dialkyldimethylammonium chlorides such as ditallowdimethylammonium chloride or methyl sulfate, etc., alkylbenzyldimethylammonium chlorides, $C_{10}$-$C_{25}$alkylimidazolium salts such as $C_{10}$-$C_{25}$alkylimidazolinium methyl sulfates, substituted polyamine salts such as N-tallow-N,N',N'-triethanol-1,3-propylenediamine dichloride or dimethyl sulfate, N-tallow-N,N,N',N',N'-pentamethyl-1,3-propylenediamine dichloride.

Additional examples of suitable surfactants are compounds generally used as surfactants denoted in the well-known manuals "Surface Active Agents", volume I by. Schwartz and Perry, and "Surface Active Agents and Detergents", volume II by Schwartz, Perry and Berch.

The surfactants may represent from 0.005% to 60%, especially 0.5% to 40% of the weight of the composition of the invention, as a function of the nature of the surfactant(s) and of the intended use of the cleaning composition.

Advantageously, the nanogel/surfactant(s) weight ratio is between 1/1 and 1/1000 and advantageously between 1/2 and 1/200.

The composition, preferably the cleaning or rinsing composition according to the invention, may also comprise at least one other additive, chosen especially from the usual additives present in compositions for cleaning or rinsing hard surfaces.

Mention may be made especially of:

chelating agents, especially of the organic phosphonate and water-soluble aminophosphonate type such as ethane 1-hydroxy-1,1-diphosphonates, aminotri(methylene diphosphonate), vinyl diphosphonates, salts of vinylphosphonic or vinyldiphosphonic acid oligomers or polymers, salts of statistical cooliqomers or copolymers of vinylphosphonic or vinyldiphosphonic acid and of acrylic acid and/or maleic anhydride and/or vinylsulfonic acid and/or acrylamidomethylpropanesulfonic acid, phosphonated polycarboxylic acid salts, polyacrylates containing phosphonate end groups, salts of vinylphosphonic or vinyldiphosphonic acid and acrylic acid cotelomers, such as those of the range Briquest® or Mirapol A300 or 400 from Rhodia (in a proportion of from 0 to 10% and preferably from 0 to 5% of the total weight of the cleaning composition);

sequestrants or antitartar agents such as polycarboxylic acids or water-soluble salts thereof and water-soluble salts of carboxylic polymers or copolymers such as polycarboxylate or hydroxypolycarboxylate ethers, polyacetic acids or salts thereof (nitriloacetic acid, N,N-dicarboxymethyl-2-aminopentanedioic acid, ethylenediaminetetraacetic acid, diethylenetriaminepentaacetic acid, ethylene-diaminetetraacetates, nitrilotriacetates, N-(2-hydroxyethyl)nitrilodiacetates), $C_5$-$C_{20}$ alkylsuccinic acid salts, carboxylic polyacetal esters, polyaspartic or polyglutamic acid salts, citric acid, adipic acid, gluconic acid or tartaric acid or salts thereof, copolymers of acrylic acid and of maleic anhydride or acrylic acid homopolymers, such as Rhodoline DP 226 35 from Rhodia and Sokalan CP5 from BASF (in a proportion of 0 to 10% of the total weight of said cleaning composition);

sulfonated polyvinylstyrenes or copolymers thereof with acrylic acid, methacrylic acid, etc., (in a proportion of 0 to 10% of the total weight of cleaning composition);

mineral "builders" (detergency adjuvants for improving the surface properties of surfactants) such as:

alkali metal, ammonium or alkanolamine polyphosphates such as Rhodiaphos HD7 sold by the company Rhodia (in a proportion of 0 to 70% of the total weight of cleaning composition);

alkali metal pyrophosphates;

alkali metal silicates, with an $SiO_2/M_2O$ ratio that may range from 1 to 4, preferably from 1.5 to 3.5 and most particularly from 1.7 to 2.8; they may be amorphous silicates or lamellar silicates sold under the references NaSKS-5, NaSKS-7, NaSKS-11 and NaSKS-6 by Clariant;

alkali metal or alkaline-earth metal borates, carbonates, bicarbonates and sesquicarbonates (in an amount that may be up to about 50% of the total weight of said cleaning composition);

cogranulates of hydrated alkali metal silicates with an $SiO_2/M_2O$ ratio that may range from 1.5 to 3.5, and of alkali metal carbonates (of sodium or potassium); mention may be made in particular of cogranulates in which the weight content of water associated with the silicate relative to the dry silicate is at least 33/100, the weight ratio of silicate to carbonate possibly ranging from 5/95 to 45/55 and preferably from 15/85 to 35/65, as described in EP-A-488 868 and EP-A-561 656, such as Nabion 15 sold by the company Rhodia;

(the total amount of "builders" possibly representing up to 90% of the total weight of said cleaning or rinsing composition);

bleaching agents of the perborate or percarbonate type optionally combined with acetylated bleaching activators such as N,N,N',N'-tetraacetylethylenediamine (TAED) or chlorinated products of the chloroisocyanurate type, or chlorinated products of the alkali metal hypochlorite type, or aqueous hydrogen peroxide solution (in a proportion of 0 to 30% of the total weight of said cleaning composition);

fillers such as sodium sulfate, sodium chloride, sodium carbonate or calcium carbonate, kaolin or silica, in a proportion of from 0 to 50% of the total weight of said composition;

bleaching catalysts containing a transition metal, iron, manganese and cobalt complexes, especially those described in U.S. Pat. Nos. 4,728,455, 5,114,606, 5,280,117, EP-A-909 809, U.S. Pat. No. 5,559,261, WO 96/23859, 96/23860 and 96/23861 (in a proportion of from 0 to 5% of the total weight of said cleaning composition);

agents for regulating the pH of the composition, which are soluble in the cleaning or rinsing medium, especially alkali metal phosphate or alkali metal carbonate, perborate or hydroxide basifying additives, or acidifying additives that are optionally cleaning agents, such as mineral acids (phosphoric acids, polyphosphoric acids, sulfamic acid, hydrochloric acid, hydrofluoric acid, sulfuric acid, nitric acid or chromic acid), carboxylic or polycarboxylic acids (acetic acid, hydroxyacetic acid, adipic acid, citric acid, formic acid, fumaric acid, gluconic acid, glutaric acid, glycolic acid, malic acid, maleic acid, lactic acid, malonic acid, oxalic acid, succinic acid and tartaric acid) or acid salts such as sodium bisulfate, or alkali metal bicarbonates and sesquicarbonates;

polymers used for controlling the viscosity of the mixture and/or the stability of the foams formed during use, such as cellulose or guar derivatives (carboxymethylcellulose, hydroxyethylcellulose, hydroxypropylguar, carboxymethylguar, carboxymethylhydroxypropylguar, etc.), xanthan gum, succinoglycan (Rheozan® sold by Rhodia), locust bean gum, carrageenans (in a proportion of 0 to 2% of the total weight of said cleaning composition);

hydrotropic agents, such as $C_2$-$C_8$ short alcohols, in particular ethanol, diols and glycols such as diethylene glycol, dipropylene glycol, sodium xylenesulfonate, sodium naphthalenesulfonate (in a proportion of from 0 to 10 g per 100 g of said cleaning composition);

moisturizers or humectants for the skin such as glycerol, urea or skin protectors such as protein hydrolyzates, plant oils such as soybean oil, cationic polymers such as cationic guar derivatives (Jaguar C13S®, Jaguar C162®, Hicare 1000® sold by the company Rhodia (in a proportion of from 0 to 40% of the total weight of said cleaning composition);

biocidal agents or disinfectants such as cationic biocides, for example quaternary monoammonium salts such as $C_{12}$-$C_{14}$ cocoalkylbenzyldimethylammonium, alkylbenzyl-dimethylammonium, cocoalkyldichlorobenzyldimethylammonium, tetradecylbenzyldimethylammonium, didecyldimethylammonium or dioctyldimethylammonium chlorides, myristyltrimethylammonium or cetyltrimethylammonium bromides, salts of monoquaternary heterocyclic amines such as laurylpyridinium, cetylpyridinium or alkylbenzyl-imidazolium chlorides, fatty alkyltriphenylphosphonium salts such as myristyltriphenylphosphonium bromide, polymeric biocides, such as those derived from the reaction of epichlorohydrin and of dimethylamine or diethylamine, of epichlorohydrin and imidazole, of 1,3-dichloro-2-propanol and dimethylamine, of 1,3-dichloro-2-propanol and 1,3-bis(dimethylamino)-2-propanol, of ethylene dichloride and 1,3-bis(dimethylamino)-2-propanol, of bis(2-chloroethyl) ether and N,N'-bis(dimethyl-aminopropyl)urea or thiourea, biguanidine polymer hydrochlorides, such as Vantocil IB, amphoteric biocides such as derivatives of N—(N'—$C_8$-$C_{18}$alkyl-3-aminopropyl)glycine, of N—(N'—(N"—$C_8$-$C_{18}$alkyl-2-aminoethyl)-2-aminoethyl)glycine or of N,N-bis(N'—$C_8$-$C_{18}$alkyl-2-aminoethyl)glycine, such as (dodecyl)(aminopropyl)glycine or (dodecyl)(di-ethylenediamine)glycine, amines such as N-(3-aminopropyl)-N-dodecyl-1,3-propanediamine, halogenated biocides such as iodophores and hypochlorite salts, such as sodium dichloroisocyanurate, phenolic biocides such as phenol, resorcinol, cresols and salicylic acid, hydrophobic biocides such as para-chloro-meta-xylenol or dichloro-meta-xylenol, 4-chloro-m-cresol, resorcinol monoacetate, mono- or poly-alkyl or aryl phenols, cresols or resorcinols, such as o-phenylphenol, p-tert-butylphenol or 6-n-amyl-m-cresol, alkyl and/or aryl chloro or bromophenols, such as o-benzyl-p-chlorophenol, halogenated diphenyl ethers, such as 2',4,4'-trichloro-2-hydroxydiphenyl ether (triclosan) or 2,2'-dihydroxy-5,5'-dibromodiphenyl ether, chlorophenesine (p-chlorophenylglyceric ether), in a proportion of from 0 to 5% of the total weight of said cleaning composition, solvents with good cleaning or degreasing activity, such as alkylbenzenes of octylbenzene type, olefins with a boiling point of at least 100° C., for instance α-olefins, preferentially 1-decene or 1-dodecene, glycol ethers of general formula R1O(R2O)mH in which R1 is an alkyl group containing from 3 to 8 carbons and each R2 is either an ethylene or propylene and m is a number ranging from 1 to 3; mention may be made of monopropylene glycol monopropyl ether, dipropylene glycol monobutyl ether, monopropylene glycol monobutyl ether, diethylene glycol monohexyl ether, monoethylene glycol monohexyl ether, monoethylene glycol monobutyl ether, and mixtures thereof, diols containing from 6 to 16 carbon atoms in their molecular structure; diols are particularly advantageous since, in addition to their degreasing properties, they may help to remove calcium salts (soaps); diols containing from 8 to 12 carbon atoms are preferred, most preferentially 2,2,4-trimethyl-1,3-pentanediol, other solvents such as pine oil, orange terpenes, benzyl alcohol, n-hexanol, phthalic alcohol esters containing 1 to 4 carbon atoms, butoxypropanol, butyl carbitol and 1-(2-n-butoxy-1-methylethoxy)propan-2-ol also known as butoxypropoxypropanol or dipropylene glycol monobutyl ether, diglycol hexyl (hexyl carbitol), butyl triglycol, and diols such as 2,2,4-trimethyl-1,3-pentanediol, and mixtures thereof, (in a proportion of from 0 to 30% of the total weight of said cleaning composition), industrial cleaning agents such as solutions of alkali metal salts of the type such as sodium or potassium phosphates, carbonates, silicates, etc. (in a proportion of from 0 to 50% of the total weight of said cleaning composition), sparingly cleaning water-soluble organic solvents such as methanol, ethanol, isopropanol, ethylene glycol, propylene glycol, and mixtures thereof (in a proportion of from 0 to 40% of the total weight of said cleaning composition), cosolvents such as monoethanolamide and/or β-amino alkanols, which are particularly advantageous in compositions with a pH of greater than 11, most particularly greater than 11.7, since they help to reduce the formation of films and of traces on hard surfaces (they may be used in a proportion of from 0.05% to 5% of the weight of the cleaning composition); solvent systems comprising monoethanolamide and/or β-amino alkanols are described in U.S. Pat. No. 5,108,660;

antifoams especially such as soaps. Soaps are alkaline salts of fatty acids, especially sodium, potassium, ammonium and alkanolammonium salts of higher fatty acids containing from about 8 to 24 carbon atoms and preferably from about 10 to 20 carbon atoms; mention may be made especially of the salts of mono-, di- and triethanolamine, of sodium and potassium, or mixtures, of fatty acids derived from coconut oil and from ground walnut oil. The amount of soap may be at least 0.005% by weight and preferably from 0.5% to 2% by weight relative to the total weight of the composition. Additional examples of foam-regulating materials are organic solvents, hydrophobic silica, silicone oil and hydrocarbons;

abrasives, such as silica and calcium carbonate;

various additives such as enzymes, fragrances, dyes, metal-corrosion inhibitors, preserving agents, optical brighteners, opacifiers or pearlescent agents, etc.

The pH of the composition forming the subject of the invention or the working pH of said composition may range from 0.5 to 14 and preferably from 1 to 14.

The compositions of alkaline type, with a pH of greater than or equal to 7.5 and preferably greater than 8.5 for household uses (most particularly with a pH from 8.5 to 12 and especially from 8.5 to 11.5) are particularly suitable for removing greasy soiling and are particularly suited to kitchen cleaning. They may comprise from 0.001% to 5% and preferably from 0.005% to 2% of their weight of the nanogel.

The alkaline compositions generally comprise, in addition to the nanogel, at least one additive chosen from:

a sequestrant or antitartar agent (in an amount ranging from 0 to 40%, preferably from 1% to 40%, more preferentially from 2% to 30% and most particularly from 5% to 20% of the weight of the composition);

a cationic biocide or disinfectant, especially of quaternary ammonium type, such as N-alkylbenzyldimethylammonium chlorides, N-alkyldimethylethylbenzylammonium chloride, N-didecyldimethylammonium halide, and di-N-alkyldimethylammonium chloride (in an amount that may range from 0 to 60%, preferably from 0 to 40%, more preferentially from 0 to 15% and most particularly from 0 to 5% of the weight of the composition);

at least one nonionic, amphoteric, zwitterionic or anionic surfactant or a mixture thereof; when a cationic surfactant is present, said composition also preferentially comprises an amphoteric and/or nonionic surfactant (the total amount of surfactants may range from 0 to 80%, preferably from 0 to 50% and most particularly from 0 to 35% of the weight of the composition);

if necessary, a pH regulator, in an amount making it possible to reach, optionally after dilution or dissolution of the composition, a working pH, ranging from 7.5 to 13; the pH regulator may especially be a buffer system comprising monoethanolamine and/or a β-aminoalkanol and potentially, but preferentially, "co-buffer" alkaline materials from the group of aqueous ammonia, C2-C4 alkanolamines, alkali metal hydroxides, silicates, borates, carbonates and bicarbonates, and mixtures thereof. The preferred co-buffers are alkali metal hydroxides;

from 0.5% to 98%, preferably from 25% to 95% and most particularly from 45% to 90% by weight of water;

a cleaning or degreasing organic solvent, in an amount that may represent from 0 to 60%, preferably from 1% to 45% and most particularly from 2% to 15% of the weight of said composition;

a co-solvent such as monoethanolamine and/or β-aminoalkanols, in an amount that may represent from 0 to 10%, preferably from 0.05% to 10% and most particularly from 0.05% to 5% of the weight of said composition;

a sparingly cleaning water-soluble organic solvent in an amount that may represent from 0 to 25%, preferably from 1% to 20% and most particularly 2% to 15% of the weight of said composition;

optionally a bleaching agent, a fragrance or other common additives.

Said alkaline compositions may be in the form of a ready-to-use formulation or alternatively of a dry or concentrated formulation to be diluted especially in water before use; they may be diluted from 1 to 10 000-fold and preferably from 1 to 1000-fold before use.

Advantageously, a kitchen cleaning formulation comprises:

from 0.001% to 1% by weight of the nanogel, from 1% to 10% by weight of water-soluble solvent, especially isopropanol, from 1% to 5% by weight of cleaning or degreasing solvent, especially butoxypropanol, from 0.1% to 2% by weight of monoethanolamine, from 0 to 5% by weight of at least one noncationic surfactant, preferably an amphoteric or nonionic surfactant, from 0 to 1% by weight of at least one cationic surfactant with disinfectant property (especially a mixture of n-alkyldimethylethylbenzylammonium chloride and n-alkyldimethylbenzylammonium chloride), the total amount of surfactant(s) representing from 1% to 50% by weight, from 0 to 2% by weight of a dicarboxylic acid as antitartar agent, from 0 to 5% of a bleaching agent, and from 70% to 98% by weight of water.

The pH of such a formulation is preferably from 7.5 to 13 and more preferentially from 8 to 12.

The compositions of acidic type, with a pH of less than 5, are particularly useful for removing soiling of mineral type; they are particularly suited to cleaning toilet pans.

They may comprise from 0.001% to 5% and preferably from 0.01% to 2% of their weight of the nanogel.

The acidic compositions generally comprise, in addition to the nanogel:

a mineral or organic acidic agent (in an amount ranging from 0.1% to 40%, preferably from 0.5% to 20% and more preferentially from 0.5% to 15% of the weight of the composition), at least one nonionic, amphoteric, zwitterionic or anionic surfactant or a mixtures thereof (the total amount of surfactants may range from 0.5% to 20% and preferably from 0.5% to 10% of the weight of the composition), optionally a cationic biocide or disinfectant, especially of quaternary ammonium type, such as N-alkylbenzyldimethylammonium chlorides, N-alkyldimethylethylbenzylammonium chloride, N-didecyldimethylammonium halide and di-N-alkyldimethylammonium chloride (in an amount that may range from 0.01% to 2% and preferably from 0.1% to 1% of the weight of the composition), optionally a thickener (in an amount ranging from 0.1% to 3% of the weight of the composition), optionally a bleaching agent (in an amount ranging from 1% to 10% of the weight of the composition), from 0.5% to 99% and preferably from 50% to 98% by weight of water, a solvent, such as glycol or an alcohol (in an amount that may range from 0 to 10% and preferably from 1% to 5% of the weight of the composition), optionally a fragrance, a preserving agent, an abrasive or other common additives.

Said acidic compositions are preferably in the form of a ready-to-use formulation.

Advantageously, a formulation for cleaning toilet pans comprises:

from 0.05% to 5% and preferably from 0.01% to 2% by weight of the nanogel, an amount of cleaning acidic agent such that the final pH of the composition is from 0.5 to 4 and preferably from 1 to 4; this amount is generally from 0.1% to about 40% and preferably between 0.5% and about 15% by weight relative to the weight of the composition; the acidic agent may especially be a mineral acid such as phosphoric acid, sulfamic acid, hydrochloric acid, hydrofluoric acid, sulfuric acid, nitric acid or chromic acid and mixtures thereof, or an organic acid, especially acetic acid, hydroxyacetic acid, adipic acid, citric acid, formic acid, fumaric acid, gluconic acid, glutaric acid, glycolic acid, malic acid, maleic acid, lactic acid, malonic acid, oxalic acid, succinic acid and tartaric acid, and also mixtures thereof, acid salts such as sodium bisulfate and mixtures thereof; the preferred amount depends on the type of acidic cleaning agent used: for example, with sulfamic acid, it is between 0.2% and 10%, with hydrochloric acid between 1% and 15%, with citric acid between 2% and 15%, with formic acid between 5% and 15%, and with phosphoric acid between 2% and 30% by weight, from 0.5% to 10% by weight of at least one surfactant, preferably an anionic or nonionic surfactant, optionally from 0.1% to 2% by weight of at least one cationic surfactant with disinfecting property (especially a mixture of n-alkyldimethylethylbenzylammonium chloride and n-alkyldimethylbenzylammonium chloride), optionally a thickener (in an amount ranging from 0.1% to 3% of the weight of the composition), of the gum type, especially a xanthan gum or a succinoglycan (Rheozan), optionally a bleaching agent (in an amount ranging from 1% to 10% of the weight of the composition), optionally a preserving agent, a dye, a fragrance or an abrasive, and from 50% to 95% by weight of water.

A few other particular embodiments and applications of the composition of the invention are detailed hereinbelow.

Thus, the composition according to the invention may be used for the facilitated cleaning treatment of glass surfaces, especially glazing. This treatment may be performed by various known techniques. Mention may be made in particular of the cleaning of glazing by spraying with a jet of water using devices of Karcher® type.

The amount of nanogel introduced will generally be such that, during the use of the cleaning composition, after optional dilution, the concentration of nanogel is between 0.001 g/l and 2 g/l and preferably between 0.005 g/l and 0.5 g/l.

The glazing cleaning composition according to the invention comprises:

from 0.001% to 10% and preferably from 0.005% to 3% by weight of the nanogel;

from 0.005% to 20% and preferably from 0.5% to 10% by weight of at least one nonionic surfactant (for example an amine oxide or an alkylpolyglucoside) and/or an anionic surfactant; and the rest being formed from water and/or various additives that are common in the field.

The glazing cleaning formulations comprising said polymer may also contain:

from 0 to 10% and advantageously from 0.5% to 5% of amphoteric surfactant, from 0 to 30% and advantageously from 0.5% to 15% of solvent such as alcohols, and the rest being formed from water and common additives (especially fragrances).

The pH of the composition is advantageously between 6 and 11.

The composition of the invention is also advantageous for the facilitated cleaning of kitchenware in an automatic machine. Said composition may be either a detergent (cleaning) formulation used in the wash cycle, or a rinsing formulation.

The detergent compositions for washing kitchenware in automatic dishwashers according to the invention advantageously comprise from 0.01% to 5% and preferably 0.1% to 3% by weight of the nanogel.

Said dishwasher detergent compositions also comprise at least one surfactant, preferably a nonionic surfactant, in an amount that may range from 0.2% to 10% and preferably from 0.5% to 5% of the weight of said detergent composition, the rest being formed from various additives and fillers, as already mentioned above. Thus, they may also comprise:

up to 90% by weight of at least one detergency adjuvant ("builder") of sodium silicate or tripolyphosphate type, up to 10%, preferably from 1% to 10% and most particularly from 2% to 8% by weight of at least one auxiliary cleaning agent, preferably a copolymer of acrylic acid and of methylpropanesulfonic acid (MPSA), up to 30% by weight of at least one bleaching agent, preferably perborate or percarbonate, optionally combined with a bleaching activator, up to 50% by weight of at least one filler, preferably sodium sulfate or sodium chloride.

The pH is advantageously between 8 and 13.

The compositions for the facilitated rinsing of kitchenware in an automatic dishwasher according to the invention may advantageously comprise from 0.02% to 10% and preferably from 0.1%. to 5% by weight of the nanogel relative to the total weight of the composition.

Said compositions may also comprise from 0.1% to 20% and preferably 0.2% to 15% by weight, relative to the total weight of said composition, of a surfactant, preferably a nonionic surfactant.

Among the preferred nonionic surfactants, mention may be made of surfactants such as polyoxyethylenated $C_6$-$C_{12}$ alkylphenols, polyoxyethylenated and/or polyoxypropylenated $C_8$-$C_{22}$ aliphatic alcohols, ethylene oxide-propylene oxide block copolymers, optionally polyoxyethylenated carboxylic amides, etc.

Said compositions may also comprise from 0 to 10% and preferably from 0.5% to 5% by weight, relative to the total weight of the composition, of a calcium-sequestering organic acid, preferably citric acid.

They may also comprise an auxiliary agent such as a copolymer of acrylic acid and of maleic anhydride or acrylic acid homopolymers in a proportion of from 0 to 15% and preferably 0.5% to 10% by weight relative to the total weight of said composition.

The pH is advantageously between 4 and 7.

A subject of the invention is also a cleaning composition for the facilitated washing of kitchenware by hand.

Preferred detergent formulations of this type comprise from 0.1 to 10 parts by weight of the nanogel per 100 parts by weight of said composition and contain from 3 to 50 and preferably from 10 to 40 parts by weight of at least one surfactant, preferably an anionic surfactant, chosen especially from saturated $C_5$-$C_{24}$ and preferably $C_8$-$C_{16}$ aliphatic alcohol sulfates, optionally condensed with about 0.5 to 30, preferably 0.5 to 8 and most particularly 0.5 to 5 mol of ethylene oxide, in acidic form or in the form of a salt, especially an alkali metal (sodium), alkaline-earth metal (calcium, magnesium), etc. salt.

They are preferentially foaming liquid detergent aqueous formulations for the facilitated washing of kitchenware by hand.

Said formulations may also contain other additives, especially other surfactants, such as:

nonionic surfactants such as amine oxides, alkylglucamides, alkyl polyglucosides, oxyalkylenated derivatives of fatty alcohols, alkylamides, alkanolamides, and amphoteric or zwitterionic surfactants, noncationic bactericides or disinfectants such as triclosan, synthetic cationic polymers, polymers for controlling the viscosity of the mixture and/or the stability of the foams formed on use, hydrotropic agents, skin moisturizers or humectants or protectors, dyes, fragrances, preserving agents, divalent salts (especially of magnesium), etc.

The pH of the composition is advantageously between 5 and 9.

Another particular embodiment of the invention consists of a composition for the facilitated external cleaning, especially of the bodywork, of motorized vehicles (cars, trucks, buses, trains, aircraft, etc.).

In this case also, it may be an actual cleaning composition or a rinsing composition.

The cleaning composition for motor vehicles advantageously comprises from 0.005% to 10% by weight of the nanogel relative to the total weight of said composition, and also:

- nonionic surfactants (in a proportion of from 0 to 30% and preferably from 0.1% to 15% of the formulation),
- amphoteric and/or zwitterionic surfactants (in a proportion of 0 to 30% and preferably from 0.01% to 10% of the formulation),
- cationic surfactants (in a proportion of from 0 to 30% and preferably from 0.05% to 15% of the formulation);
- anionic surfactants (in a proportion of 0 to 30% and preferably from 0.1% to 15% of the formulation);
- detergency adjuvants ("builders") (in a proportion of from 1% to 99% and preferably from 40% to 98% of the formulation);
- hydrotropic agents;
- fillers, pH regulators, etc.

The minimum amount of surfactant present in this type of composition is preferably at least 0.5% of the formulation.

The pH of the composition is advantageously between 8 and 13.

The composition of the invention is also particularly suitable for the facilitated cleaning of hard surfaces of ceramic type (tiles, baths, sinks, etc.), especially for bathrooms. It may especially facilitate the cleaning of soap scum.

The cleaning formulation advantageously comprises from 0.02% to 5% by weight of the nanogel relative to the total weight of said composition, and also at least one surfactant.

Preferred surfactants include nonionic surfactants, especially the compounds produced by condensation of alkylene oxide groups of hydrophilic nature with a hydrophobic organic compound that may be of aliphatic or alkylaromatic nature.

The length of the hydrophilic chain or of the polyoxyalkylene radical condensed with any hydrophobic group may be readily adjusted to obtain a water-soluble compound having the desired degree of hydrophilic/hydrophobic balance (HLB).

The amount of nonionic surfactants in the composition of the invention may be from 0 to 30% by weight and preferably from 0 to 20% by weight.

An anionic surfactant may optionally be present in an amount of from 0 to 30% and advantageously 0 to 20% by weight.

It is also possible but not obligatory to add amphoteric, cationic or zwitterionic detergents.

The total amount of surfactant compounds used in this type of composition is generally between 0.5% and 50%, preferably between 1% and 30% by weight and more particularly between 2% and 20% by weight relative to the total weight of the composition.

Said cleaning composition may also comprise other minor ingredients, such as:

- detergency adjuvants ("builders") as mentioned previously (in an amount that may be between 0.1% and 25% by weight relative to the total weight of the composition),
- a foam regulator, as mentioned above, especially of soap type (in an amount generally of at least 0.005% by weight and preferably from 0.5% to 2% by weight relative to the total weight of the composition),
- pH regulators, dyes, optical brighteners, soiling suspension agents, detergent enzymes, compatible bleaching agents, agents for regulating the formation of gel, freezing-thawing stabilizers, bactericides, preserving agents, solvents, fungicides, insect repellents, hydrotropic agents, fragrances and opacifiers or pearlescent agents.

The pH of the composition is advantageously between 2 and 12.

The composition according to the invention is also suitable for the facilitated rinsing of shower walls.

The aqueous compositions for rinsing shower walls comprise from 0.02% to 5% by weight and advantageously from 0.05% to 1% of the nanogel.

The other main active components of the aqueous shower rinsing compositions of the present invention are at least one surfactant present in an amount ranging from 0.5% to 5% by weight and optionally a metal-chelating agent as mentioned above, present in an amount ranging from 0.01% to 5% by weight.

The aqueous shower rinsing compositions advantageously contain water with, optionally, at least one lower alcohol in major proportion and additives in minor proportion (between about 0.1% and about 5% by weight, more advantageously between about 0.5% and about 3% by weight and even more preferentially between about 1% and about 2% by weight).

Certain surfactants that may be used in this type of application are described in U.S. Pat. Nos. 5,536,452 and 5,587,022, the content of which is incorporated by reference into the present description.

Preferred surfactants are polyethoxylated fatty esters, for example polyethoxylated sorbitan oleates and polyethoxylated castor oil. Particular examples of such surfactants are the products of condensation of 20 mol of ethylene oxide and of sorbitan monooleate (sold by Rhodia Inc. under the name Alkamuls PSMO-20® with an HLB of 15.0) and 30 or 40 mol of ethylene oxide and castor oil (sold by Rhodia Inc. under the name Alkamuls EL-620® (HLB of 12.0) and EL-719® (HLB of 13.6), respectively). The degree of ethoxylation is preferably sufficient to obtain a surfactant with an HLB of greater than 13.

The pH of the composition is advantageously between 7 and 11.

The composition according to the invention may also be used for the facilitated cleaning of vitroceramic plates.

Advantageously, the formulations for cleaniny vitroceramic plates of the invention comprise:

- 0.01% to 5% by weight of the nanogel;
- 0.1% to 1% by weight of a thickener such as a xanthan gum;
- 10% to 60% by weight of an abrasive agent such as calcium carbonate or silica;
- 0 to 7% by weight of a solvent such as butyldiglycol;
- 1% to 10% by weight of a nonionic surfactant; and
- optionally basifying agents or sequestrants.

The pH of the composition is advantageously between 7 and 12.

As mentioned above, the composition according to the invention may also be used in the field of industrial cleaning, especially for the facilitated cleaning of reactors.

Advantageously, said compositions comprise:

- from 0.02% to 5% by weight of the nanogel;
- from 1% to 50% by weight of alkali metal salts (sodium or potassium phosphates, carbonates, silicates);
- from 1% to 30% by weight of a mixture of surfactants, especially of nonionic surfactants such as ethoxylated fatty alcohols and anionic surfactants such as lauryl benzene sulfonate;

from 0 to 30% by weight of a solvent such as diisobutyl ester.

The pH of such a composition is generally from 8 to 14.

Another subject of the invention consists of the use, in a composition, preferably comprising at least one surfactant, for the modification and/or treatment of hard surfaces, preferably for the cleaning or rinsing in aqueous or aqueous-alcoholic medium of hard surfaces, of the nanogel, for example as an agent for affording said surfaces properties of antideposition and/or anLiadhesion of soiling liable Lo be deposited on said surfaces.

Another subject of the invention consists of a process for treating and/or modifying hard surfaces, in order to improve the properties of compositions optionally comprising at least one surfactant, preferably for the cleaning or rinsing in aqueous or aqueous-alcoholic medium of hard surfaces, by addition of the nanogel to said compositions.

Another subject of the invention consists of a process for treating and/or modifying hard surfaces, preferably to facilitate the cleaning or rinsing of hard surfaces, by placing said surfaces in contact with a composition in aqueous or aqueous-alcoholic medium, comprising the nanogel and optionally at least one surfactant.

The nanogel is preferably used or is present in said composition in an amount that is effective for affording said surfaces properties of hydrophilicity antideposition and/or antiadhesion of the soiling liable to be deposited on said surfaces.

The nature and the amounts of the nanogel present or used in said composition, and similarly the other additives and various modes of application of said composition, have already been mentioned above.

The compositions of the invention may be foaming compositions. They may especially be compositions for washing up by hand or, in the case of manual or semi-automatic washing products, vehicle cleaning compositions. The nanogel in these compositions may stabilize the foam, especially on addition of soiling. Moreover, it may serve, in the case of washing products, as an antiredeposition agent.

Other details or advantages may emerge in the light of the examples thaL follow.

Example 1

Preparation of Polymers and Comparative Polymers

In these examples, the following abbreviations are used:

AM=acrylamide

MBA=N,N'-methylenebisacrylamide (crosslinking monomer)

MAPTAC=(3-methacrylamidopropyl)trimethylammonium chloride

APTAC=(3-acrylamidopropyl)trimethylammonium chloride

The examples marked by the letter C indicate comparative examples.

Example 1.1C

Preparation of a Nonionic Nanogel Based on AM and MBA

MBA=8 mol %–xanthate=2.9 mol %

0.92 g ($4.42\times10^{-1}$ mol) of xanthate EtOC(=S)SCH($CH_3$)$COOCH_3$, 13.2 g of ethanol and 66.8 g of deionized water are placed in a two-necked round-bottomed flask on which is mounted a condenser. The reaction mixture is brought to 70° C. At this temperature, 0.153 g ($3.98\times10^{-4}$ mol) of V50 are added. At this moment, 2.01 g (0.013 mol) of MBA and 21.22 g (0.30 mol) of AM are added over 4 hours. During this time, at $t_0$+2 hours and $t_0$+4 hours, 0.052 ($1.92\times10^{-4}$ mol) of V50 are added, respectively. At the end of the addition, the reaction is continued for a further 2 hours.

(CES MALS) Mw=168 000. Conversion of the monomers (HPLC)>99%.

Example 1.2C

Preparation of a Linear Copolymer Based on AM and MAPTAC

A linear copolymer containing 95 mol % of acrylamide and 5 mol % of MAPTAC, with an average molecular mass of 400 kg/mol, is prepared.

Example 1.3

Preparation of a Cationic Nanogel Based on AM, MAPTAC and MBA-AM/MAPTAC/MBA AM/MAPTAC=95/5 mol/mol–MBA=10 mol %–xanthate=1.1 mol %

0.32 g ($1.54\times10^{-3}$ mol) of xanthate EtOC(=S)SCH($CH_3$)$COOCH_3$, 35 g of ethanol and 51.6 g of deionized water are placed in a two-necked round-bottomed flask on which is mounted a condenser. The reaction mixture is brought to 70° C. At this temperature, 0.167 g ($6.18\times10^{-4}$ mol) of V50 are added. At this moment, 1.83 g (0.012 mol) of MBA, 18.4 g (0.26 mol) of AM and 3.02 g (0.014 mol) of MAPTAC are added over 4 hours. During this time, at $t_0$+2 hours, 0.042 ($1.54\times10^{-4}$ mol) of V50 are added, respectively. At the end of the addition, the reaction is continued for a further 2 hours.

(CES MALS) Mw=2 900 000. Monomer conversion (HPLC)>99%.

Example 1.4

Preparation of a Cationic Nanogel Based on AM, MAPTAC and MBA-AM/MAPTAC/MBA–AM/MAPTAC=95/5 mol/mol–MBA=8 mol %–xanthate=1.1 mol %

0.32 g ($1.54\times10^{-3}$ mol) of xanthate EtOC(=S)SCH($CH_3$)$COOCH_3$, 35 g of ethanol and 51.6 g of deionized water are placed in a two-necked round-bottomed flask on which is mounted a condenser. The reaction mixture is brought to 70° C. At this temperature, 0.162 g ($5.99\times10^{-4}$ mol) of V50 are added. At this moment, 1.83 g (0.013 mol) of MBA, 19.6 g (0.28 mol) of AM and 3.23 g (0.015 mol) of MAPTAC are added over 4 hours. During this time, at $t_0$+2 hours, 0.042 ($1.54\times10^{-4}$ mol) of V50 are added, respectively. At the end of the addition, the reaction is continued for a further 2 hours.

(CES MALS) Mw=1 400 000. Monomer conversion (HPLC)>99%.

The mean size of the macromolecules, measured by the dynamic light scattering technique, is 98 nm.

Example 2

Foaming Compositions for Laundry Care

The following compositions are prepared (per 1000 g of composition):

Formulation 1

0.8 g LABS (linear alkyl benzenesulfonate, anionic surfactant)

0.5 g Rhodasurf L7/90 (nonionic surfactant)

2 g sodium tripolyphosphate test polymer: nature and amounts given in the results section 1.5 g $Na_2SO_4$ tap water up to 1000 g.

Formulation 2

0.8 g LABS (linear alkyl benzenesulfonate, anionic surfactant)

0.5 g Rhodasurf L7/90 (nonionic surfactant)

1.5 g sodium tripolyphosphate test polymer: nature and amounts given in the results section 2 g $Na_2SO_4$ tap water up to 1000 g.

The foam index and the persistence of the foam are tested according to the protocol detailed below.

The soiling redeposition effect is tested on laundry with the aid of the protocol detailed below.

Foam Index and Foam Persistence Tests

The foam index and the foam persistence, for a test composition, are determined using the cylinder device below, according to the protocol below.

Description of the Cylinder Device

The device has six parallel Plexiglas® cylinders fixed to a rotating frame. Each cylinder has an inside diameter of 9 cm and a working height of 29 cm. Each cylinder comprises a graduated scale for measuring the foam height. The cylinders are fixed onto a rotating frame, each occupying a position equivalent to the others. The frame, driven by an electric motor, is made to rotate about itself, driving the cylinders in rotation along an axis perpendicular to their length crossing said cylinders at the middle of their length in the plane of the frame. The composition in a cylinder flows in the cylinder and hits its extremities (the bottom and the top) during the rotation, thus generating turbulence leading to the formation of foam. Each cylinder is closed with a removable cap, pierced with a hole 8 mm in diameter allowing the addition of additives (soiling, etc.). This hole is stoppered using a rubber stopper when the cylinders are placed in rotation. The foam height is determined by reading the graduated scale when the cylinders are in the vertical position after rotation:

Foam height=height of (foam+liquid composition)−height of liquid composition.

The foam height unit (FHU) is defined as follows: 10 FHU corresponds to a foam height of 25 mm.

The rotation speed is 20 revolutions per minute. The cylinders are placed in rotation in series of 10 rotations (which each last 30 seconds), followed by 3 minutes of standing between each series, so as to allow measurement of the foam height (performed at the end of the three minutes) and the optional addition of soiling.

Each cylinder contains 500 ml of test composition. The test composition has an initial controlled temperature of 20° C.

Protocol for Measuring the Foam Index:

500 ml of test composition are placed in a cylinder, taking care to avoid the formation of foam. The frame bearing the cylinders is then placed in rotation in six series of 10 rotations (total of 60 rotations), each series being followed by a waiting time of 3 minutes. The foam height in the cylinder after the 3 minutes is recorded.

The foam index is defined as the foam height, given as FHU, after the 6th 3-minute waiting period.

For the sake of accuracy, each measurement is repeated at least twice, and the foam index is the average.

Foam Persistence Protocol:

After the sixth series of (10 rotations+3 minutes of waiting time), an addition implementation is performed by adding to the cylinder 5 drops (0.15 g calibrated with a laboratory balance) of hot (80° C.) liquid soiling. The cylinder is then subjected to 10 subsequent rotations at 20 revolutions per minute. The foam height is then measured after 3 minutes following the 10 rotations (total of 60+10=70 rotations). The soiling addition implementation may be repeated by adding the soiling just after measuring the foam height and just before the subsequent rotation.

The rotations/waiting/measurement/addition of soiling implementation is repeated until the foam height reaches a value of less than 10 FHU.

For the sake of accuracy, each measurement is repeated at least twice, and the average is reported.

The foam height may be plotted or reported as a function of the number of rotations (the soiling is added only after 60 rotations). The foam height (foam persistence) during the addition of soiling is of particular interest. A small decrease in foam indicates stabilization of the foam in the presence of soiling.

Soiling Composition

The soiling used in the example is synthetic sebum simulating fat soiling, for instance that originating from human skin, mixed with a clay (bentonite) simulating particulate soiling (dust, etc.). The weight ratio between the synthetic sebum and the clay is 12/4.

Composition per 950 g of synthetic sebum:

| Synthetic sebum | | |
|---|---|---|
| Ingredient | g | % |
| Palmitic acid | 100 | 10.5 |
| Stearic acid | 50 | 5.3 |
| Sebacic acid | 50 | 5.3 |
| Oleic acid | 100 | 10.5 |
| Linoleic acid | 50 | 5.3 |
| Paraffin wax (40-50° C.) | 100 | 10.5 |
| Coconut oil | 100 | 10.5 |
| Squalene | 50 | 5.3 |
| Mineral oil | 200 | 21.1 |
| Soybean oil | 50 | 5.3 |
| Rapeseed oil | 100 | 10.5 |

Preparation: The ingredients are placed in a Pyrex® beaker and heated at 80° C. for 15 minutes, with magnetic stirring on a hotplate. The liquid formed is transparent and weakly colored. On cooling, it forms a white opaque waxy paste, which may be stored for several weeks in a freezer.

At the time of evaluation of the foam persistence, the final soiling is prepared by melting 12 of sebum, at 80° C. with mechanical stirring, and adding thereto 4 g of clay. The soiling, which has become opaque and slightly viscous, is stirred throughout the operation. A fresh sample of mixture is prepared for each new experiment, and the soiling is never kept for more than one hour.

Protocol for Testing the Redeposition of Soiling on Laundry

The test is performed in several steps:

preparation of the fabric—white cotton fabric is used. The finishing is removed by washing with hot water without washing product measurement of the color of the fabric (white)—washing of the white fabric is performed with the test laundry product alone. After drying, the color of the fabric is measured using a colorimetric probe (LUCI reflectometer)

deposition of soiling (clay+water)—the soiling is deposited on the fabric, this soiling being formed from a water/bentonite mixture with 10 g of bentonite per 100 g of water. To deposit the soiling, the fabric is dipped in the mixture and is stirred using a tergotometer for 7 minutes drying at room temperature measurement of the color before washing washing of the fabric drying at room temperature measurement of the color after washing The test laundry product, used for the washes, is a Brazilian washing product of ACE brand, to which is added the test polymer. 0.025 g of active polymer is used per 5 g of washing product.

A percentage of removal of the soiling is calculated as follows:

"white"=specimen prewashed only

"before washing"=specimen prewashed and stained

"after washing"=specimen prewashed, stained and washed

The reflectometer is equipped with software that directly calculates the Delta E (experimental detergency) from the data recorded previously on the fabric before and after washing. This value corresponds to the recorded color variation and is expressed as follows:

$$\text{Delta } L = L_{after\ washing} - L_{before\ washing}$$

$$\text{Delta } a = a_{after\ washing} - a_{before\ washing}$$

$$\text{Delta } b = b_{after\ washing} - b_{before\ washing}$$

$$\boxed{\Delta E = \sqrt{\Delta L^2 + \Delta a^2 + \Delta b^2}} = \text{EXPERIMENTAL DETERGENCY}$$

Similarly, by means of the data recorded on the fabric before and after staining, the software makes it possible to calculate the Delta E' (theoretical maximum detergency) as follows:

$$\text{Delta } L' = L_{white} - L_{before\ washing}$$

$$\text{Delta } a' = a_{white} - a_{before\ washing}$$

$$\text{Delta } b' = b_{white} - b_{before\ washing}$$

$$\boxed{\Delta E = \sqrt{\Delta L'^2 + \Delta a'^2 + \Delta' b^2}} = \text{THEORETICAL DETERGENCY}$$

$$\frac{\%\text{REMOVAL}}{} = 100 \times \text{EXPERIMENTAL DET./THEORETICAL DET.}$$

The percentage of removal is reported below as a value related to the redeposition (the higher the value, the lower the redeposition).

Results

| Example | 2.1c | 2.2c | 2.3 |
|---|---|---|---|
| Formulation | 1 | 2 | 1 |
| Test polymer | Control - none | 0.05 g - Example 1.2c | 0.05 g - Example 1.3 |

-continued

| Example | 2.1c | 2.2c | 2.3 |
|---|---|---|---|
| Amount of polymer (foam tests) | 0 | 0.05 g (50 ppm) | 0.05 g (50 ppm) |
| Amount of polymer (redeposition) | 0 | 0.025 g per 5 g of washing product | 0.025 g per 5 g of washing product |
| Foam index (FHU) | 70 | 72 | 70 |
| Foam persistence (FHU after three soiling addition implementations) | 28 | 41 | 50 |
| Redeposition | 92 | 86 | 94 |

Example 3

Bathroom Cleaning Compositions

The following compositions are prepared:

| Example | 3.1c | 3.2c | 3.3c | 3.4 |
|---|---|---|---|---|
| Vector | Distilled water | Distilled water | Distilled water | Distilled water |
| Surfactant: Synperonic A7, Uniquema | 0.5% | 0.5% | 0.5% | 0.5% |
| Test polymer | Control - no polymer | 200 ppm - Example 1.1c | 250 ppm - commercial polymer* | 07JWN305 200 ppm - Example 1.4 |
| pH (by addition, where appropriate, of citric acid or citrate) | 4 | 4 | 4 | 4 |

* Mirapol Surf S 500, sold by Rhodia (amount expressed as polymer active material weight in the commercial product)

The surface modification is evaluated using the compositions according to the following protocol.

Small black ceramic tiles are used. The first operation consists in preparing the tile. To do this, it suffices to clean it with ethanol using a paper towel. Half the surface is treated with the test composition (comprising a polymer) and the other half with the control composition. To do this, 5 drops of product are added and spread out using a paper towel. The tile dries for 1 minute and is then rinsed with a stream of 4.5 L/minute for 5 seconds on each side. The tile dries again in the vertical position. The soiling is prepared from a soap solution at 13% by mass in water and from a solution at 35% by mass in ethanol of $MgCl_2.6H_2O$. The soap solution is heated so as to make it liquid. 10.5 g of this solution are added to 18 g of ethanol, followed by addition of 1.5 mL of the $MgCl_2$ solution. Five drops of the model soiling are immediately deposited (before precipitation) onto the tile on both halves. The soiling is then dried in an oven at 40° C. for 25 minutes. It is then rinsed off at a flow rate of 6 L/minute for 3 minutes. If the soiling leaves before the allotted time, the time is noted in order to make differentiations between the compositions, if necessary. The test consists in evaluating the amount of soiling that has left using a scale that goes from 0 to 5. The best compositions are those for which the note 5 is obtained. For the consecutive cycles, further soiling is added once the tile is dry, without adding further composition. The soiling is then dried in the oven, etc.

Results

| Example | 3.1c | 3.2c | 3.3c | 3.4 |
|---|---|---|---|---|
| Evaluation after 1 cycle | 0 | 4 | 5 | 5 |
| Evaluation after 3 cycles | / | / | 4.8 | 5 |
| Evaluation after 6 cycles | / | / | 3.5 | 4.9 |

The composition of the invention allows efficient and long-lasting treatment, which is resistant to rinsing.

Example 4

Adsorption on a Surface

A composition is prepared, comprising:
distilled water
50 ppm by weight of the test polymer
pH 6 (by addition of hydrochloric acid or NaOH)
$10^{-3}$ M KCl The kinetics of adsorption of the nanogel of the composition on a silicon oxide wafer (surface similar to that of a glass or ceramic surface, available from Silicon Inc., under the description "100 mm Silicon Wafers, single side polished, P-type, (100) orientation, thickness 500-550 microns, with 1000 (±3%) Angstroms $SiO_2$ applied, clean room processed and packaged") are monitored by reflectometry. The process is performed by comparison using a reference comprising distilled water and $10^{-3}$ M KCl, according to the method below:

The technique is based on light reflection: a polarized beam of an He—Ne laser (632.8 nm) penetrates a cell via a glass prism at the Brewster angle at the water/silicon interface) (71°) on a silicon wafer covered with a thin film of the adsorbent support to be studied. The beam is reflected and then split into two components (perpendicular Is and parallel Ip) and then recovered by photodiodes. The magnitude recorded during the adsorption is ΔS=S-So in volts. So is the value of S=Ip/Is in the presence only of the solvent in the cell with the substrate. The measurement is taken at the "stagnation" point. At this point, no flow exists, so as to avoid coupling between the molecule transport mechanism and its organization at the surface. The flow of solution of polymer to be studied is conveyed into the cell only by difference in level; it must be laminar of the order of 2 ml/minute. To calculate the adsorbed amount Γ, it is necessary to determine using an optical model the sensitivity factor As. This factor depends on the wavelength of the laser, the angle of incidence, the thickness of the adsorbent and the refractive indices of the solvent and of the surface. It is then possible to deduce the adsorbed amount Γ in $mg/m^2$ via the relationship $\Gamma=(1/As)(\Delta S/So)$. ($As=0.1711*dn/dc=0.1711*0.17=0.029$).

The resistance of the adsorption to rinsing with a solution comprising distilled water and $10^{-3}$ M KCl is tested.

Results:

| Example | 4.1C | 4.2 |
|---|---|---|
| Test polymer | Example 1.2 of document WO 2007/071 591 | Example 1.3 |
| Adsorbed amount (plateau after 4 minutes) | 0.9 | 1.08 |

-continued

| Example | 4.1C | 4.2 |
|---|---|---|
| Resistance to rinsing | Resists | Resists |

Example 5

Modification of a Glass Surface

Compositions are prepared, comprising:
distilled water
50 ppm by weight of the test polymer
pH 6

Treatment/modifications of the surfaces: 10 cm×15 cm glass plates are used. The plates are washed with a Decon 90 10% alkaline solution. Next, they are rinsed with tap water and then with distilled water. They are wiped with a paper towel (precision wipes, Kimtech, Kimberly-Clark) and sprayed with the above compositions. The tiles are again wiped with a paper towel and left to dry for about 30 minutes.

the contact angle of a drop of distilled water is measured using a goniometer (Rame-hart Inc. NRL C.A. Goniometer, model No. 100-00-230), before and after the above treatment/modification. The final value is reported. A low value for the final value indicates large hydrophilic character.

| Example | 5.1C | 5.2 | 5.3 |
|---|---|---|---|
| Test polymer | Example 1.2 of document WO 2007/071 591 | Example 1.3 | Example 1.4 |
| Final value | 9-10° | 5.2° | 6.9° |

The invention claimed is:

1. A composition comprising a cationic nanogel, comprising chemically crosslinked macromolecules comprising a core C, wherein said nanogel comprises:

crosslinking units R derived from a crosslinking monomer R comprising at least two polymerizable groups, and core units C derived from at least one monomer C comprising only one polymerizable group, comprising:

wherein the core units C comprise:

cationic or potentially cationic units $C_{cat}$ derived from at least one cationic or potentially cationic monomer $C_{cat}$, and optionally, hydrophilic or hydrophobic neutral units $C_N$, derived from at least one hydrophilic or hydrophobic neutral monomer $C_N$, further wherein:

the nanogel is different than a star copolymer that comprises macromolecular branches at the periphery of the core, and the average size of said macromolecules ranges from 5 to 500 nm.

2. The composition of claim 1, wherein the nanogel is obtainable via a process comprising a controlled radical polymerization.

3. The composition of claim 1, wherein the crosslinking units R comprise units derived from a diethylenically unsaturated or triethylenically unsaturated monomer.

4. The composition of claim 1, wherein the nanogel is obtainable by polymerization of a mixture of monomers comprising:

at least one crosslinking monomer R comprising at least two polymerizable groups, and at least one monomer C comprising only one polymerizable group, wherein monomer C comprises:

at least one cationic or potentially cationic monomer $C_{cat}$, and optionally a hydrophilic or hydrophobic neutral monomer $C_N$.

5. The composition of claim 3, wherein the at least one crosslinking monomer R comprises a polyethylenically unsaturated monomer.

6. The composition of claim 4, wherein the at least one monomer C comprises a monoethylenically unsaturated monomer.

7. The composition of claim 4, wherein the mole ratio of the monomer(s) C to the crosslinking monomer R is greater than or equal to 1.

8. The composition of claim 4, wherein:

the nanogel is obtainable via a process comprising a controlled radical polymerization comprising control groups, and the mole ratio of the number of control groups to the number of polymerizable groups in the crosslinking monomer R ranges from 0.05 to 0.5.

9. The composition of claim 1, wherein the nanogel comprises hydrophilic neutral units $C_{Nphilic}$ derived from a hydrophilic neutral monomer $C_{Nphilic}$.

10. The composition of claim 9, wherein the mole ratio of the units $C_{cat}$ to the units ranges from 1/99 to 50/50.

11. The composition of claim 1, wherein the at least one cationic or potentially cationic monomer $C_{cat}$ comprises:

a N,N-dimethylaminomethyl-acrylamide or -methacrylamide;

a 2-(N,N-dimethylamino)ethyl-acrylamide or -methacrylamide;

a 3-(N,N-dimethylamino)propyl-acrylamide or -methacrylamide;

a 4-(N,N-dimethylamino)butyl-acrylamide or -methacrylamide;

a 2-(dimethylamino)ethyl acrylate (ADAM);

a 2-(dimethylamino)ethyl methacrylate (DMAM or MADAM);

a 3-(dimethylamino)propyl methacrylate, 2-(tert-butylamino)ethyl methacrylate;

a 2-(dipentylamino)ethyl methacrylate;

a 2-(diethylamino)ethyl methacrylate;

a vinylpyridine;

a vinylamine;

a vinylimidazoline;

a trimethylammoniumpropyl methacrylate chloride;

a trimethylammoniumethylacrylamide or methacrylamide chloride or bromide;

a trimethylammoniumbutylacrylamide or methacrylamide methyl sulfate;

a trimethylammoniumpropylmethacrylamide methyl sulfate (MAPTA MeS);

a (3-methacrylamidopropyl)trimethylammonium chloride (MAPTAC);

a (3-acrylamidopropyl)trimethylammonium chloride (APTAC);

a methacryloyloxyethyltrimethylammonium chloride or methyl sulfate;

an acryloyloxyethyltrimethylammonium salt (ADAMQUAT);

a 1-ethyl-2-vinylpyridinium or 1-ethyl-4-vinylpyridinium bromide, chloride or methyl sulfate;

a N,N-dimethyldiallylammonium chloride (DADMAC);

a dimethylaminopropylmethacrylamide N-(3-chloro-2-hydroxypropyl)trimethylammonium chloride (DIQUAT);

the monomer of formula

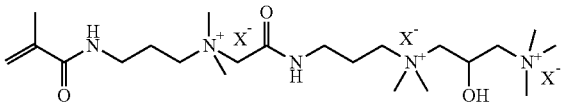

wherein $X^-$ comprises an anion; or a combination thereof.

12. The composition of claim 1, wherein the optional neutral units $C_N$ comprise a hydrophilic neutral units $C_{Nphilic}$ derived from monomers $C_{Nphilic}$ comprising:

hydroxyethyl acrylates or methacrylates, acrylamide, methacrylamide, vinyl alcohol, vinylpyrrolidone, or vinylcaprolactam.

13. The composition of claim 1, wherein the nanogel comprises a molar mass of at least 350,000 g/mol.

14. The composition of claim 1, wherein said composition is adapted to treat hard surfaces or textile surfaces.

15. The composition of claim 1, further comprising at least one surfactant.

16. A method for treating a hard or textile surface comprising contacting said surface with a composition comprising:

a cationic nanogel, comprising chemically crosslinked macromolecules comprising a core C, wherein said nanogel comprises:

crosslinking units R derived from a crosslinking monomer R comprising at least two polymerizable groups, and core units C derived from at least one monomer C comprising only one polymerizable group, comprising:

wherein the core units C comprise:

cationic or potentially cationic units $C_{cat}$ derived from at least one cationic or potentially cationic monomer $C_{cat}$, and optionally, hydrophilic or hydrophobic neutral units $C_N$, derived from at least one hydrophilic or hydrophobic neutral monomer $C_N$, further wherein:

the nanogel is different than a star copolymer that comprises macromolecular branches at the periphery of the core, and the average size of said macromolecules ranges from 5 to 500 nm.

17. The method of claim 16, wherein:

contacting said surface comprises washing laundry by hand or in a semiautomatic machine, and the cationic nanogel stabilizes a foam and/or prevents redeposition of a soil.

18. The method of claim 16, wherein:

the surface is a hard surface and treating the hard surface comprises cleaning the hard surface, and the nanogel hydrophilizes the surface and/or prevents soiling of the surface.

19. The method of claim 16, further comprising diluting the composition before treating the hard or textile surface.

* * * * *